US008594539B2

(12) United States Patent
Sakai

(10) Patent No.: US 8,594,539 B2
(45) Date of Patent: Nov. 26, 2013

(54) OUTLET RECESS FOR A POWDER CONTAINER FOR AN IMAGE FORMING APPARATUS

(75) Inventor: Yoshiaki Sakai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 294 days.

(21) Appl. No.: 13/089,936

(22) Filed: Apr. 19, 2011

(65) Prior Publication Data

US 2012/0099901 A1 Apr. 26, 2012

(30) Foreign Application Priority Data

Oct. 25, 2010 (JP) ..... 2010-239080

(51) Int. Cl.
*G03G 15/08* (2006.01)

(52) U.S. Cl.
USPC ..... 399/258; 399/260; 399/262

(58) Field of Classification Search
USPC ..... 399/258, 260, 262
See application file for complete search history.

(56) References Cited

U.S. PATENT DOCUMENTS 6,292,644 B1 9/2001 Goto et al.
7,729,645 B2 * 6/2010 Noguchi ..... 399/262
2007/0147900 A1 * 6/2007 Taguchi et al. ..... 399/258
2009/0238608 A1 9/2009 Murase et al.
2009/0245854 A1 10/2009 Sakuma
2011/0064480 A1 * 3/2011 Nakasone ..... 399/262

FOREIGN PATENT DOCUMENTS

JP 2004-198459 A 7/2004
JP 2006-243446 A 9/2006
JP 2009-229938 A 10/2009

OTHER PUBLICATIONS

Communication dated Dec. 22, 2011, issued by the Australian Patent Office in counterpart Australian Application No. 2011201937.

* cited by examiner

*Primary Examiner* — G. M. Hyder
(74) *Attorney, Agent, or Firm* — Sughrue Mion, PLLC

(57) ABSTRACT

An image forming apparatus includes: an inlet connected to an outlet of a container body for developer; a leakage preventing member arranged in the surroundings of the inlet and preventing leakage of the developer; and recesses that are arranged on an upstream side and a downstream side of the outlet with reference to the direction of movement that the developer container body moves when the developer container body is moved in a state that the developer container body is supported by a container support section and that are formed in a shape depressed in a direction of departing relative to an opening and closing member for opens and closes the outlet, the recesses collecting developer having adhered to the leakage preventing member when the developer container body is moved.

3 Claims, 24 Drawing Sheets

12
27
15
14
15a
13d
34
32
31a
31
13c
V4
V3
26a
26
22
41
11a
11
47
44
11c
2
23
3b 12
27
14
15
15a
34
32
31a
31
26
26a
22
13d
13c
V3
V4
47
41
11a
11
44
11c
2
23
3b

OUTLET RECESS FOR A POWDER CONTAINER FOR AN IMAGE FORMING APPARATUS

CROSS-REFERENCE TO RELATED APPLICATIONS

This application is based on and claims priority under 35 USC 119 from Japanese Patent Application No. 2010-239080 filed on Oct. 25, 2010.

BACKGROUND

1. Technical Field

The present invention relates to an image forming apparatus.

2. Related Art

An image forming apparatus is proposed that includes a developer accommodation container for supplying developer consumed in association with image formation operation and an attaching and detaching body capable of being replaced, by attaching and detaching, in order to change or repair a consumable member.

SUMMARY

According to an aspect of the invention, an image forming apparatus includes: a powder container body, a container support section and an opening and closing member.

The powder container body is attached to a body of the image forming apparatus in an attachable and detachable manner. The powder container body includes: an accommodation section that accommodates powder, an outlet that connects the accommodation section to an outside and allows the powder to flow out therethrough, and recesses that are arranged on an upstream side and a downstream side of the outlet with reference to a direction of movement of the powder container body and that are formed in a shape depressed in a direction of departing relative to the opening and closing member.

The container support section supports the powder container body in the attachable and detachable manner. The container support section includes: an inlet that is connected to the outlet, and a leakage preventing member that is arranged in surroundings of the inlet and contacts with surroundings of the outlet so as to prevent leakage of the powder.

The opening and closing member is supported in a movable manner relative to the powder container body between an open position where the outlet is opened and a closed position where the outlet is closed, and moves relative to the powder container body when, in a state that the powder container body is supported by the container support section, the powder container body is moved in an opening or a closing direction set up in advance.

BRIEF DESCRIPTION OF THE DRAWINGS

Exemplary embodiment(s) of the present invention will be described in detail based on the following figures, wherein:

FIG. 9A is an explanation diagram showing a state that a toner cartridge is inserted into a cartridge holder, and FIG. 9B is an explanation diagram showing a state that a toner cartridge has rotated and moved from a position shown in FIG. 9A to an attached position;

FIG. 10A is an explanation diagram showing a state that an inlet shutter has moved to a closed position, and FIG. 10B is an explanation diagram showing a state that an inlet shutter has moved to an open position;

FIG. 11A is a sectional view and FIG. 11B is a perspective sectional view;

FIG. 12A is a perspective view looked obliquely from left above and FIG. 12B is a perspective view looked obliquely from left below;

FIG. 14A is an explanation diagram showing a state that a shutter of a toner cartridge has moved to a closed position and FIG. 14B is an explanation diagram showing a state that a shutter of a toner cartridge has moved to an open position;

FIG. 15A is a sectional view taken along line XVA-XVA in FIG. 12A and FIG. 15B is an enlarged view of a main part of an outlet part in FIG. 15A;

FIG. 17A is a perspective explanation diagram showing a state that a cartridge cover is attached and FIG. 17B is a perspective explanation diagram showing a state that a cartridge cover is removed;

FIG. 18A is a side view and FIG. 18B is an explanation diagram looked obliquely from a left front side, FIG. 18C is an explanation diagram looked obliquely from a left rear side, FIG. 18D is a sectional view taken along line XVIIID-XVIIID in FIG. 18A;

FIG. 19A is a side view, FIG. 19B is an explanation diagram looked obliquely from a left front side, FIG. 19C is an explanation diagram looked obliquely from a left rear side and FIG. 19D is a sectional view taken along line XIXD-XIXD in FIG. 19A;

FIG. 20A is a side view showing a state that a storage medium is supported by an accommodation body, FIG. 20B is a side view showing a state that a storage medium is removed from an accommodation body, FIG. 20C is an explanation diagram showing a state that a storage medium is supported by an accommodation body, which is looked obliquely from a front side, FIG. 20D is an explanation diagram showing a state that a storage medium is removed from an accommodation body, which is looked obliquely from a front side, FIG. 20E is a view looked from a back face side in FIG. 20A and FIG. 20F is a view looked from a back face side in FIG. 20B;

FIG. 21A is an explanation diagram showing a state that a toner cartridge has moved to an unlocked position, FIG. 21B is an explanation diagram showing a state that a toner cartridge has moved from a position shown in FIG. 21A to a locked position side, FIG. 21C is an explanation diagram showing a state that a toner cartridge has moved further from a position shown in FIG. 21B to a locked position side, FIG. 21D is an explanation diagram showing a state that a toner cartridge has moved further from a position shown in FIG. 21C to a locked position side, FIG. 21E is an explanation diagram showing a state that a toner cartridge has moved further from a position shown in FIG. 21D to a locked position side and FIG. 21F is an explanation diagram showing a state that a toner cartridge has moved to a locked position side;

FIG. 22A is an explanation diagram showing a state that a toner cartridge has moved to a locked position, FIG. 22B is an explanation diagram showing a state that a toner cartridge has moved from a position shown in FIG. 22A to an unlocked position side, FIG. 22C is an explanation diagram showing a state that a toner cartridge has moved further from a position shown in FIG. 22B to an unlocked position side, FIG. 22D is an explanation diagram showing a state that a toner cartridge has moved further from a position shown in FIG. 22C to an unlocked position side, FIG. 22E is an explanation diagram showing a state that a toner cartridge has moved further from a position shown in FIG. 22D to an unlocked position side and FIG. 22F is an explanation diagram showing a state that a toner cartridge has moved to an unlocked position side;

FIG. 23A is an explanation diagram of seals according to Exemplary Embodiment 1 and FIG. 23B is an explanation diagram of conventional seals; FIG. 24A is an explanation diagram showing a state that a toner cartridge has moved to a locked position and FIG. 24B is an explanation diagram showing a state that a toner cartridge has moved from a locked position toward an unlocked position.

DETAILED DESCRIPTION

Figure 1:
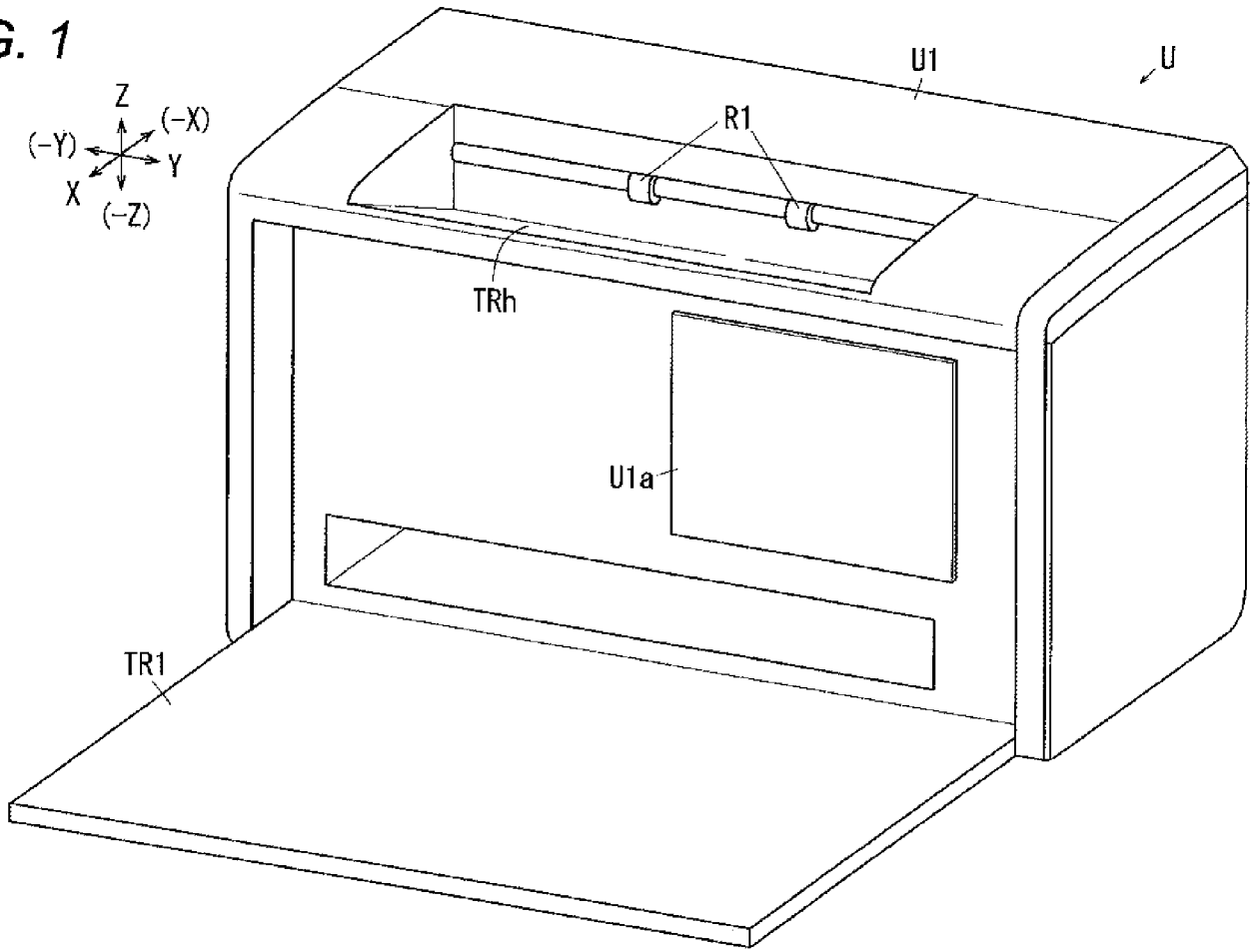
FIG. 1 is a perspective view of an image forming apparatus according to Exemplary Embodiment 1.

Next, exemplary embodiments serving as detailed examples of implementation of the present invention are described below with reference to the drawings. However, the present invention is not limited to the following embodiments.

Here, for the purpose of easiness of understanding of the following description, in the drawings, the front and rear directions are referred to as X-axis directions, the right and left directions are referred to as Y-axis directions, and the up and down directions are referred to as Z-axis directions. Then, the directions indicated by arrows X, −X, Y, −Y, Z, and −Z are respectively referred to as the front direction, the rear direction, the right direction, the left direction, the up direction, and the down direction or, alternatively, the front side, the rear side, the right side, the left side, the upside, and the downside.

Further, in the figures, a mark constructed from a "•" inside a "○" indicates an arrow directed from the back side of the page to the front side. Further, a mark constructed from a "x" inside a "○" indicates an arrow directed from the front side of the page to the back side.

Here, in the description employing the following drawings, for the purpose of easiness of understanding, illustration is omitted suitably for members other than those necessary for the description.

Exemplary Embodiment 1

FIG. 1 is a perspective view of an image forming apparatus according to Exemplary Embodiment 1.

In FIG. 1, in a printer U serving as an example of an image forming apparatus according to Exemplary Embodiment 1, its lower front part is provided with a sheet feed tray TR1 serving as an example of a sheet feeding section for accommodating a recording sheet S serving as an example of a medium. Further, the upper face of the printer U is provided with an ejection tray TRh serving as an example of an ejection section into which a sheet S on which an image has been recorded is ejected. Further, the front right part is provided with a front cover U1*a* serving as an example of an opening and closing part that is opened and closed when a toner cartridge TC that serves as an example of an attaching and detaching body described later and as an example of a developer accommodation container (or, a powder accommodation container) and that accommodates developer as an example of powder in the inside is operated.

Figure 2:
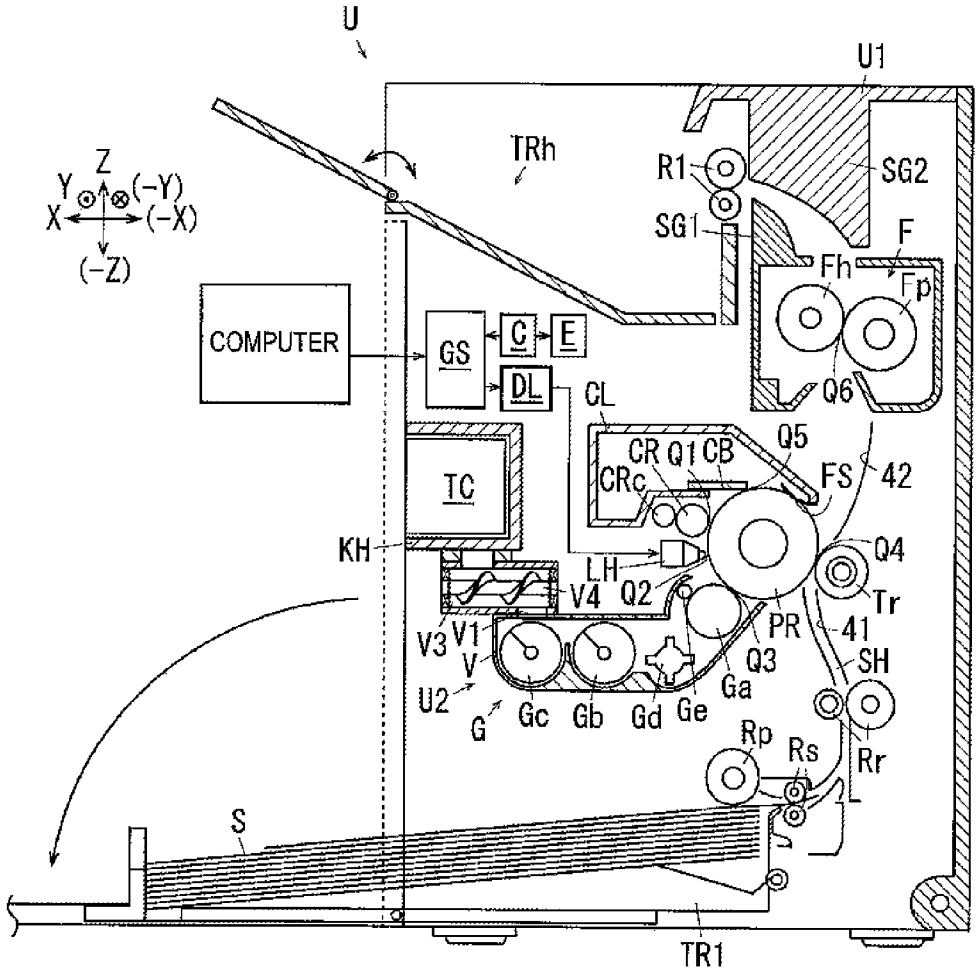
FIG. 2 is an explanation diagram showing the entire system of an image forming apparatus according to Exemplary Embodiment 1.

FIG. 2 is an explanation diagram showing the entire system of an image forming apparatus according to Exemplary Embodiment 1.

In FIG. 2, the printer U has a printer body U1 serving as an example of a body of an image forming apparatus. The printer body U1 includes: a controller C serving as an example of a control section; an image processing section GS whose operation is controlled by the controller C; a laser drive circuit DL serving as an example of a latent image forming circuit; a power supply E; and the like. The power supply E supplies a voltage to: an electrostatic charging roll CR serving as an example of an electrostatic charger; a developing roller Ga serving as an example of a developing member; a transfer roller Tr serving as an example of a transfer member; and the like.

The image processing section GS converts, into image information for latent image formation, print information inputted from a computer or the like serving as an example of an external information transmitting apparatus, and then outputs the converted information to the laser drive circuit DL at a time occasion, that is, timing, set up in advance. The laser drive circuit DL outputs a driving signal to a latent image forming apparatus LH in correspondence to the inputted image information. The latent image forming apparatus LH according to Exemplary Embodiment 1 is constructed from a so-called LED head which is an apparatus in which LEDs serving as an example of latent image writing elements are linearly arranged in the right and left directions at intervals set up in advance.

In the rear part of the printer body U1, a photosensitive body PR is supported that serves as an example of a rotating image carrying body. In the surroundings of the photosensitive body PR, arranged along the rotation direction of the photosensitive body PR are: the electrostatic charging roll CR serving as an example of an electrostatic charger; the latent image forming apparatus LH; a developing apparatus G; the transfer roller Tr serving as an example of a transfer device; and a photosensitive body cleaner CL serving as an example of a cleaning device for the image carrying body.

In FIG. 2, an electrostatic charging roll cleaner CRc serving as an example of a cleaning device for electrostatic charger that cleans the surface of the electrostatic charging roll CR is arranged in opposite to and in contact with the electrostatic charging roll CR.

Further, the developing apparatus G has a development container V that accommodates developer in the inside. In the inside of the development container V, arranged are: the developing roll Ga arranged in opposite to the photosensitive body PR; a pair of conveyance members Gb and Gc for stirring developer so as to achieve circulation conveyance; a supply member Gd for supplying to the developing roll Ga the developer stirred by the conveyance members Gb and Gc; and a layer thickness regulation member Ge for restricting the layer thickness of the developer on the surface of the developing roll Ga.

In the front upper face of the development container V, a developer supply opening V1 is formed that serves as an example of a supply section. The developer supply opening V1 is linked to a developer supply path V3 serving as an example of a developer conveyance path extending forward. In the inside of the developer supply path V3, a supply auger V4 serving as an example of a developer conveying member is supported in a rotatable manner. At the front end of the developer supply path V3, a cartridge holder KH is linked that serves as an example of an attaching and detaching section to which the toner cartridge TC is attached in an attachable and detachable manner. Then, developer from the toner cartridge TC flows into the cartridge holder KH. Thus, when the supply auger V4 is driven in correspondence to the consumption of developer in the developing apparatus G, developer is supplied from the toner cartridge TC to the developing apparatus G.

The surface of the rotating photosensitive body PR is electrostatically charged by the electrostatic charging roll CR in an electrostatic charging region Q1. Then, at a latent image formation position Q2, an electrostatic latent image is formed by latent image formation light emitted from the latent image forming apparatus LH. In a developing region Q3, the electrostatic latent image is developed by the developing roll Ga into a toner image serving as an example of a visible image. Then, in a transfer region Q4 formed as a region where the photosensitive body PR and the transfer roller Tr are opposed to each other, the image is transferred by the transfer roller Tr onto the recording sheet S serving as an example of a medium. In a cleaning region Q5 serving as an example of a cleaning region in the downstream of the transfer region Q4, residual toner on the photosensitive body PR surface is removed by a cleaning blade CB serving as an example of a cleaning member, and then collected into the inside of the photosensitive body cleaner CL.

Here, on the side opposite to the cleaning blade CB, a film seal FS is provided that serves as an example of a scattering preventing member. The film seal FS prevents the toner collected into the photosensitive body cleaner CL from dropping to the outside.

In FIG. 2, in the lower part of the printer body U1, the sheet feed tray TR1 is provided with a pickup roll Rp serving as an example of a medium extraction member. The recording sheet S extracted by the pickup roll Rp is separated sheet by sheet by shuffling rolls Rs consisting of a retard roll and a feed roll serving as an example of medium shuffling members, then conveyed along a sheet conveyance path SH, and then conveyed to the transfer region Q4 at timing set up in advance by a resistance roll Rr serving as an example of a time adjustment member arranged in the upstream of the transfer region Q4 in the sheet conveying direction.

The transfer roller Tr to which a transfer voltage is applied from the power supply E whose operation is controlled by the controller C transfers the toner image on the photosensitive body PR onto the recording sheet S passing through the transfer region Q4.

The recording sheet S onto which the toner image has been transferred in the transfer region Q4 is conveyed to a fixing apparatus F in a state that the toner image is not-yet-fixed. The fixing apparatus F has a pair of fixing rolls Fh and Fp serving as an example of fixing members. Then, a fixing region Q6 is formed by a pressed contact region of the pair of fixing rolls Fh and Fp. On the recording sheet S conveyed by the fixing apparatus F, the toner image is fixed by the pair of fixing rolls Fh and Fp in the fixing region Q6. The recording sheet S on which the fixed toner image is formed is guided by sheet guides SG1 and SG2 serving as an example of medium guiding members, and then ejected from an ejection roll R1 serving as an example of an ejection member to the ejection tray TRh in the upper face of the printer body U1.

(Explanation of Cartridge Holder KH)

Figure 3:
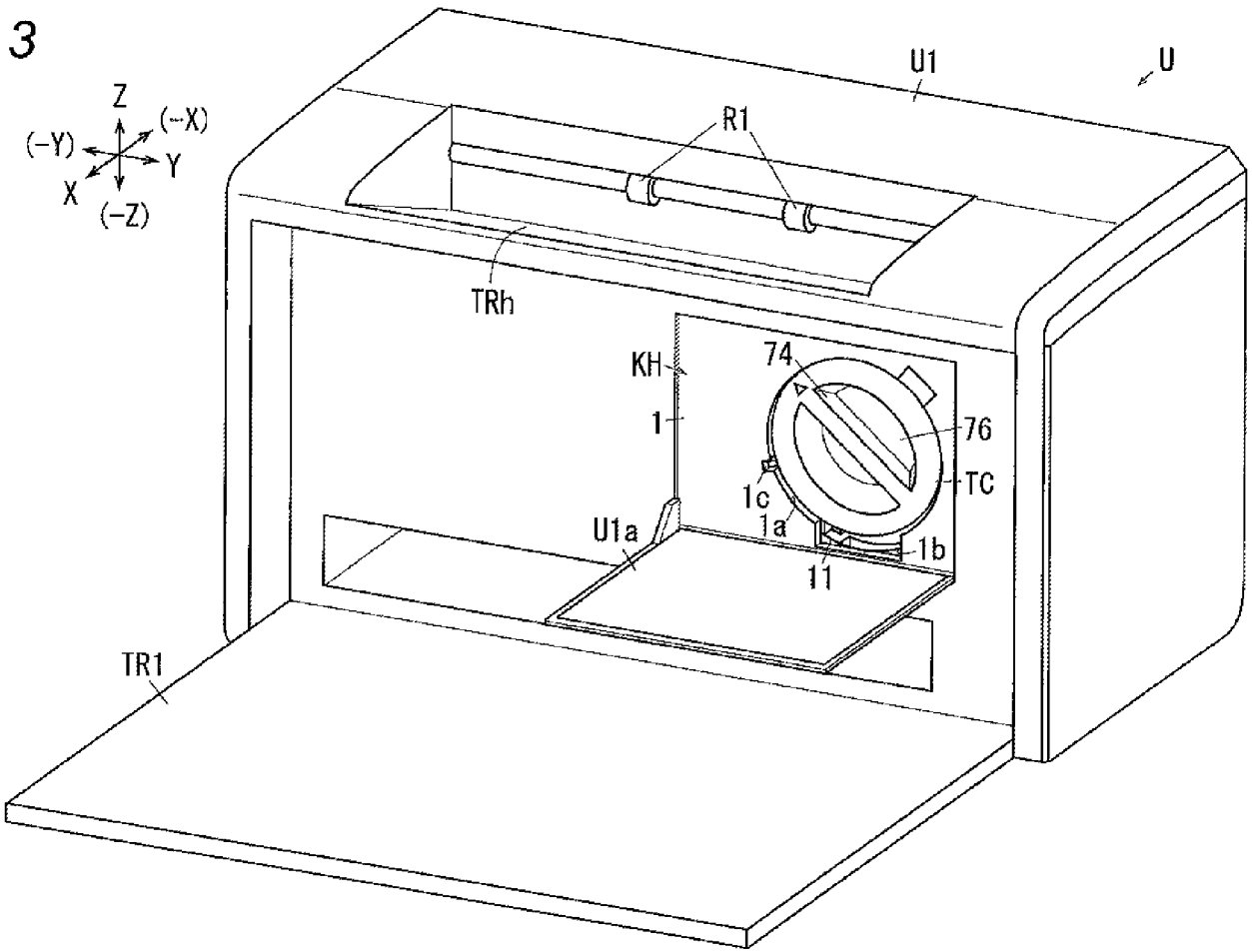
FIG. 3 is an explanation diagram of an image forming apparatus according to Exemplary Embodiment 1 in a state that a front cover is opened.

FIG. 3 is an explanation diagram of an image forming apparatus according to Exemplary Embodiment 1 in a state that a front cover is opened.

Figure 4:
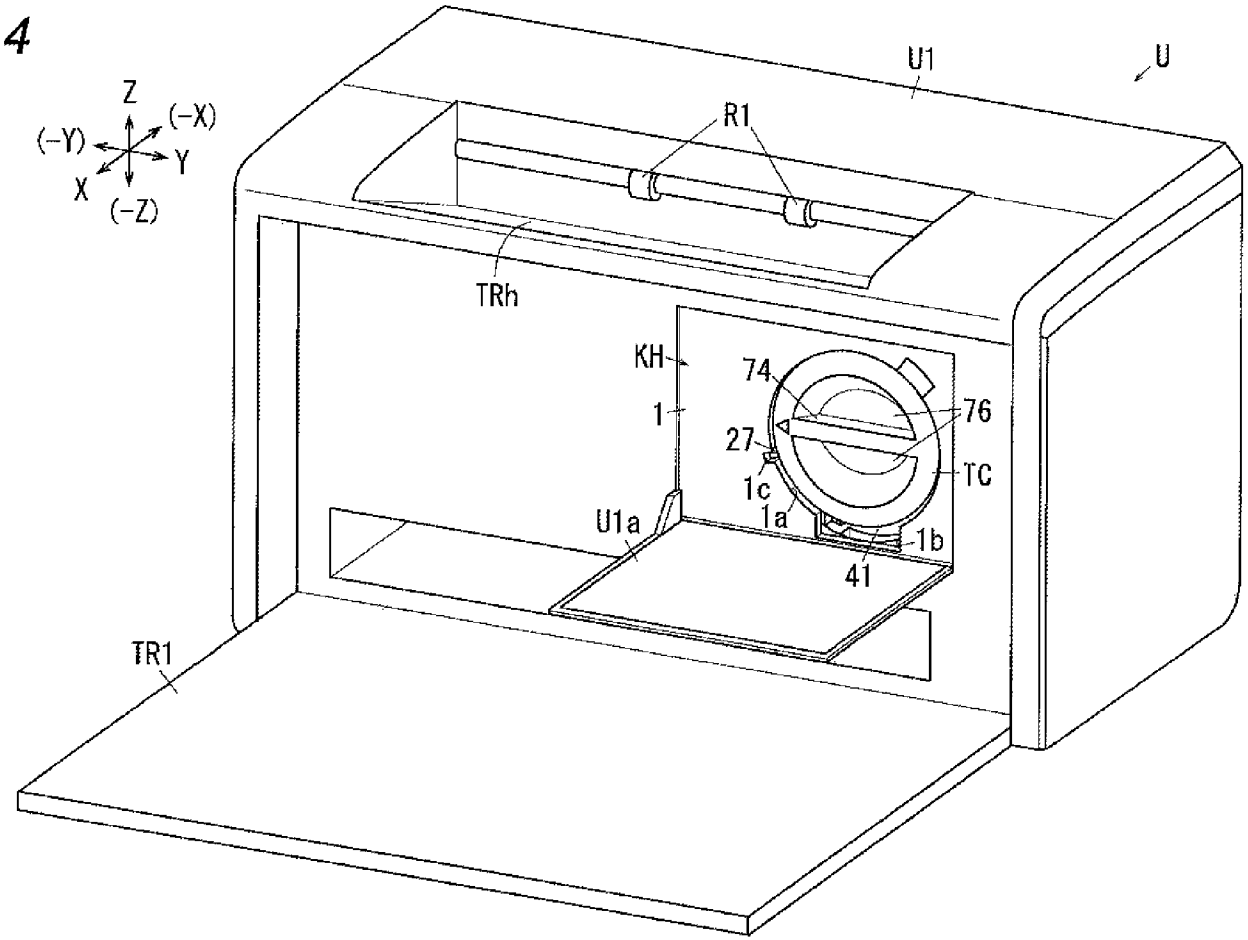
FIG. 4 is an explanation diagram showing a state that a toner cartridge has rotated and moved from an attached position shown in FIG. 3 to a detachable position.

FIG. 4 is an explanation diagram showing a state that a toner cartridge has rotated and moved from an attached position shown in FIG. 3 to a detachable position.

In FIGS. 1, 3, and 4, when the front cover U1*a* of the printer U according to Exemplary Embodiment 1 is moved from a normal position shown in FIG. 1 to an operating position shown in FIGS. 3 and 4, the toner cartridge TC serving as an example of a developer accommodation container and the cartridge holder KH serving as an example of a container support section for supporting the toner cartridge TC are exposed to the outside.

Figure 5:
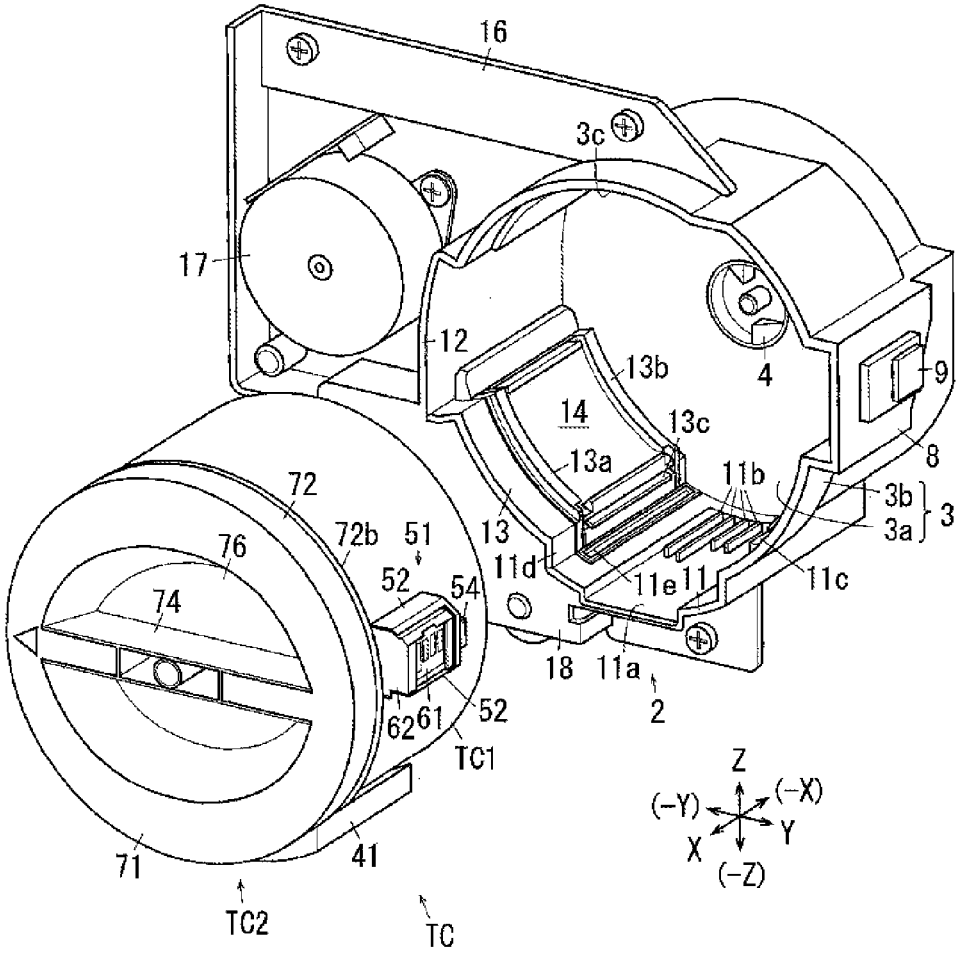
FIG. 5 is an explanation diagram showing a main part in a state that a toner cartridge has been removed from a cartridge holder.

FIG. 5 is an explanation diagram showing a main part in a state that a toner cartridge has been removed from a cartridge holder.

Figure 6:
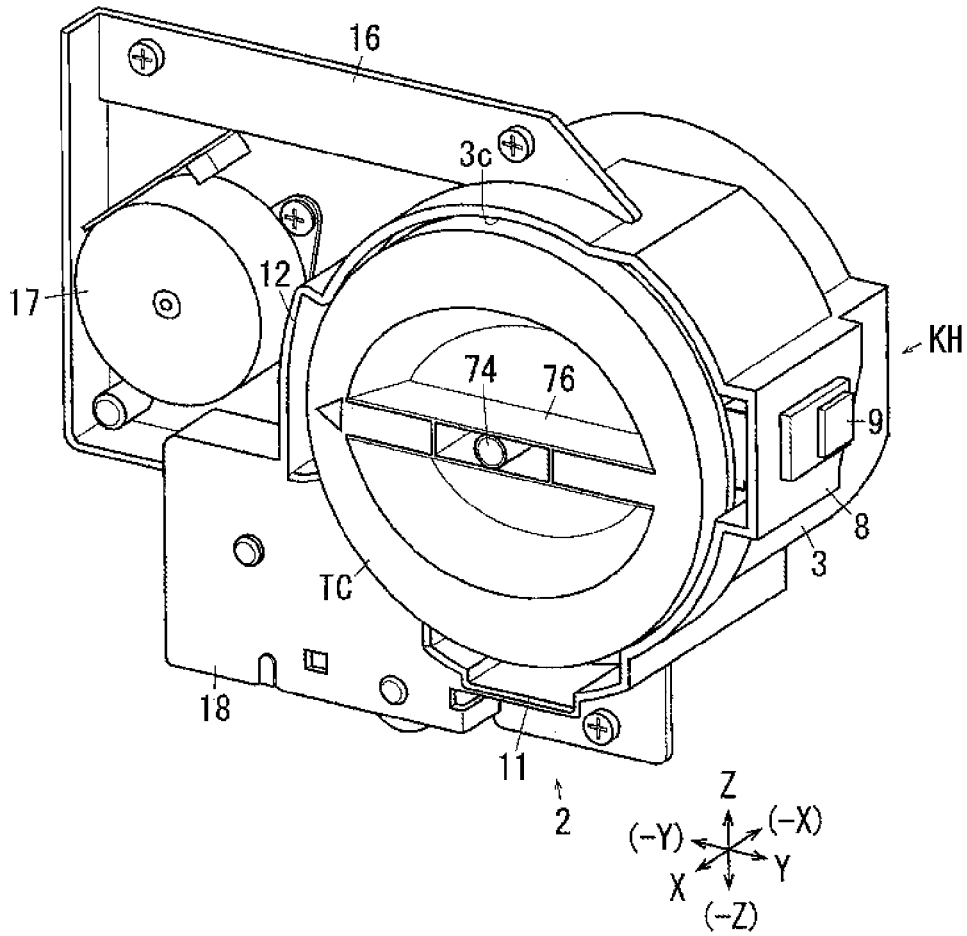
FIG. 6 is an explanation diagram showing a main part in a state that a toner cartridge has been inserted into a cartridge holder and moved to a detachable position.

FIG. 6 is an explanation diagram showing a main part in a state that a toner cartridge has been inserted into a cartridge holder and moved to a detachable position.

Figure 7:
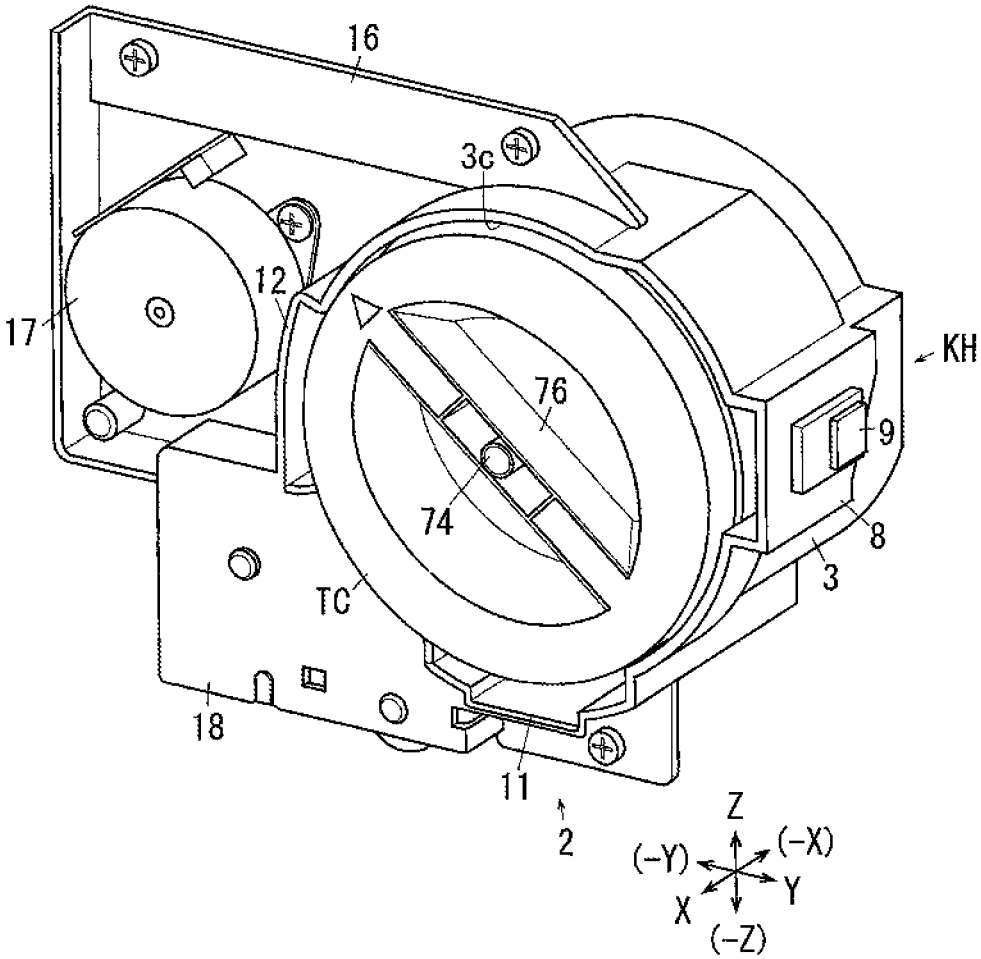
FIG. 7 is an explanation diagram showing a state that a toner cartridge inserted into a cartridge holder has moved to an attached position.

FIG. 7 is an explanation diagram showing a state that a toner cartridge inserted into a cartridge holder has moved to an attached position.

Figure 8:
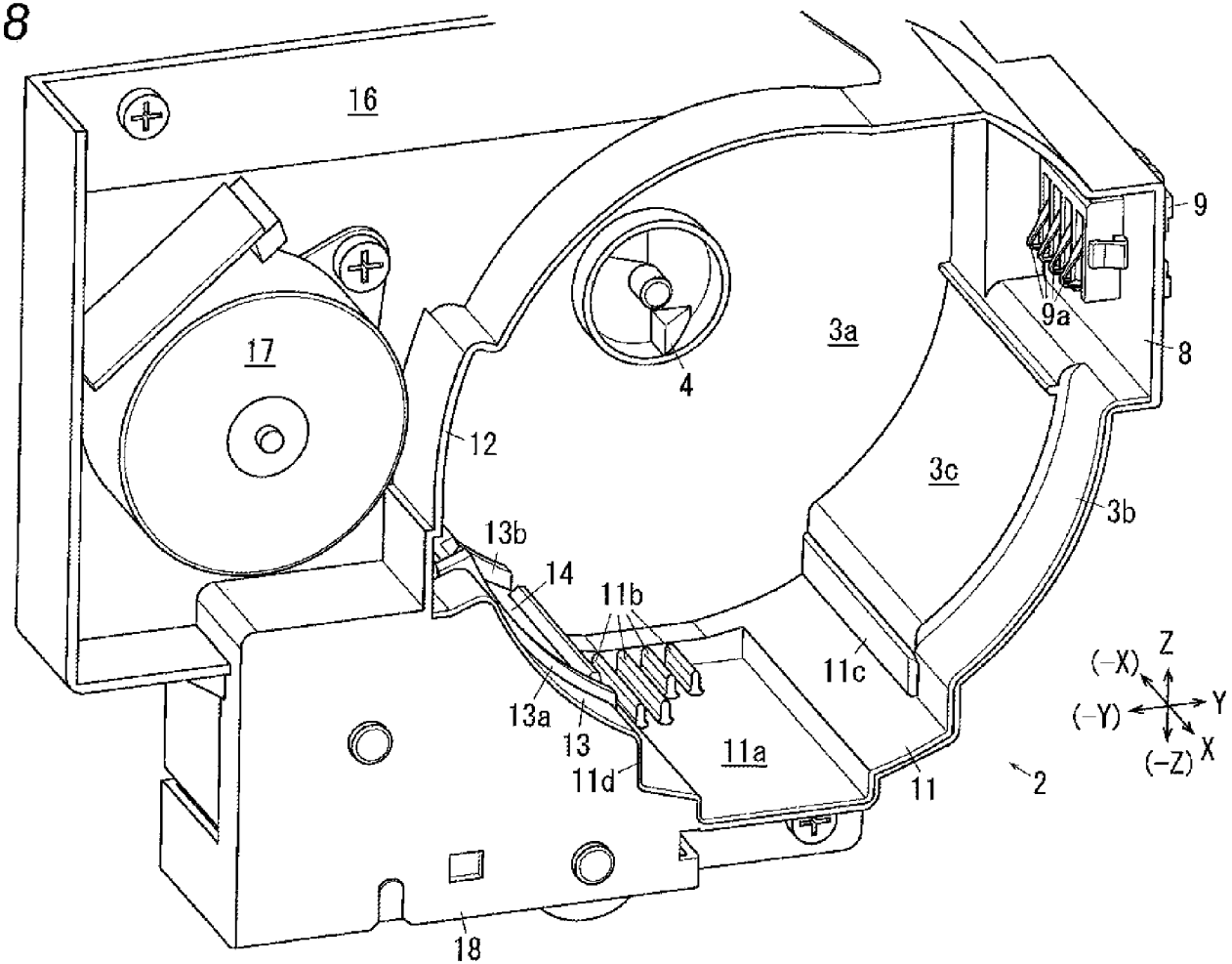
FIG. 8 is an explanation diagram of a cartridge holder viewed obliquely from left above.

FIG. 8 is an explanation diagram of a cartridge holder viewed obliquely from left above.

In FIGS. 3 and 4, the cartridge holder KH is supported by the printer body U1 serving as an example of a body of an image forming apparatus and as an example of a to-be attached and detached apparatus, and has a front panel 1 serving as an example of a front member. In the front panel 1, an opening 1*a* having the shape of a circular hole to which the toner cartridge TC is attached and detached is formed. At the lower end of the opening 1*a*, a shutter passing section 1*b* depressed downward is formed that serves as an example of a passing section for an opening and closing member. Then, in the left part of the opening 1*a*, a projected rim passing section 1*c* is formed that has the shape of a notch.

In FIGS. 5 to 8, in the inside of the front panel 1, a holder body 2 is supported that serves as an example of a body of the container support section. The holder body 2 has a cartridge accommodation section 3 that serves as an example of an accommodation section for the attaching and detaching body and that is constructed from a cylindrical recess whose axis direction is equal to the front and rear directions which is in the cartridge insertion direction.

Figure 9A:
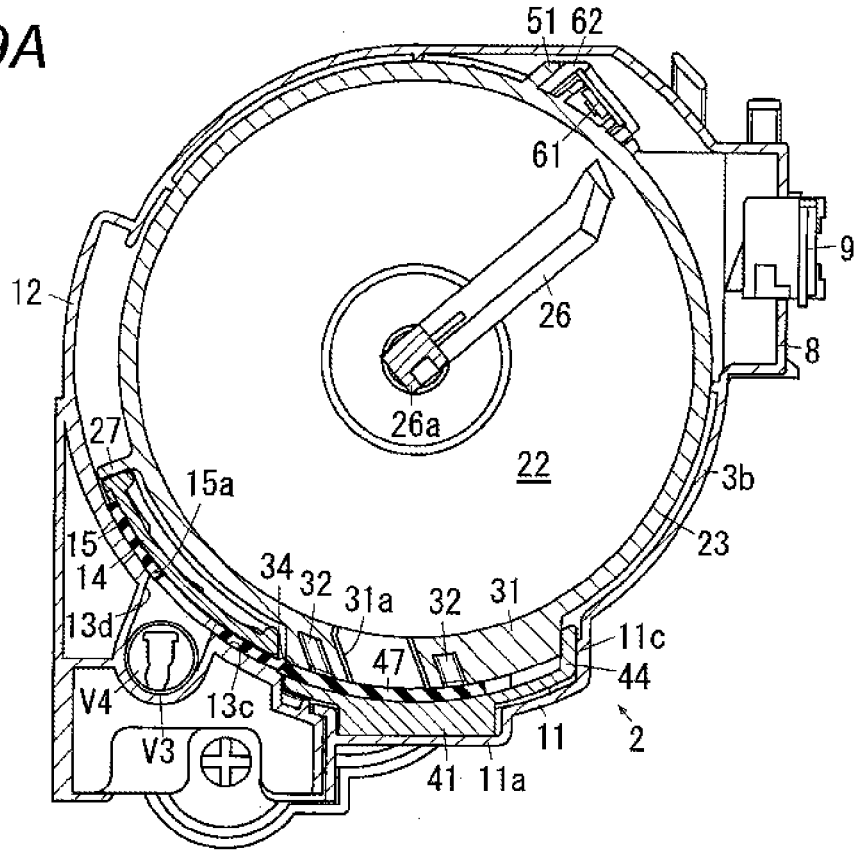
FIGS. 9A and 9B are explanation diagrams of a cartridge holder and a toner cartridge according to Exemplary Embodiment 1.
Figure 9B:
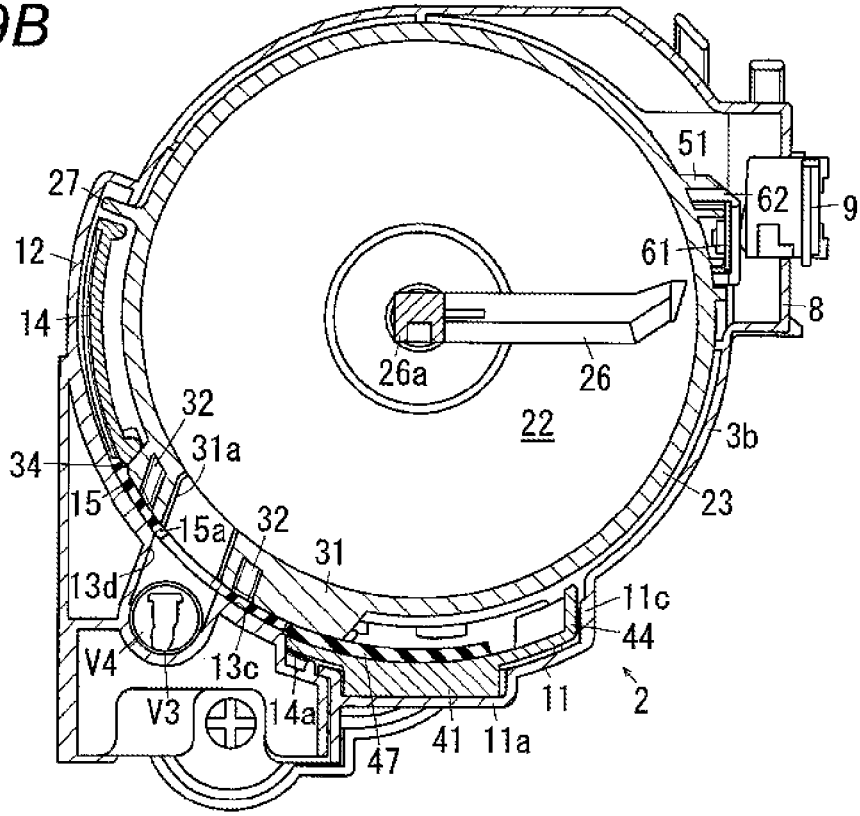

FIGS. 9A and 9B are explanation diagrams of a cartridge holder and a toner cartridge according to Exemplary Embodiment 1. FIG. 9A is an explanation diagram showing a state that a toner cartridge is inserted into a cartridge holder. FIG. 9B is an explanation diagram showing a state that a toner cartridge has rotated and moved from a position shown in FIG. 9A to an attached position.

In FIG. 5, the cartridge accommodation section 3 has: a disk-shaped rear end wall 3*a*; and a barrel wall 3*b* extending forward from the rear end wall 3*a*. In the center part of the rear end wall 3*a*, a drive coupling 4 serving as an example of a driving transmission member is supported in a rotatable manner.

In FIGS. 5 to 9B, in the upper right portion of the barrel wall 3*b*, a reader support section 8 is formed that is depressed in the right direction and the upper right direction relative to the inner peripheral surface 3*c* of the barrel wall 3*b* and that serves as an example of a read support section. In the reader support section 8, a CRUM reader 9 is supported that can transmit and receive information so as to read and write the information and that serves as an example of an information R/W apparatus. In FIG. 8, the CRUM reader 9 has a connector 9*a* that is constructed from flat springs protruding inward relative to the barrel wall 3*b* and that serves as an example of a contact terminal.

In FIGS. 5 to 9B, in the lower part of the barrel wall 3*b*, shutter accommodation section 11 is formed that is depressed downward relative to the inner peripheral surface 3*c* of the barrel wall 3*b*, that is, outward in the radial direction of the barrel wall 3*b*, and that serves as an example of an opening and closing accommodation section. In FIGS. 5 and 8, in the bottom part of the shutter accommodation section 11, a recess 11*a* having a shape depressed downward is formed. Then, in the recess 11*a*, a body-side hardkey 11*b* is formed that is constructed from a plurality of projected rims extending in the front and rear directions of the body and that serves as an example of an identification section. In FIG. 8, in the right side face of the shutter accommodation section 11, a backlash stuffing section 11*c* is formed that has a shape extending in the front and rear directions and stepped leftward and that serves as an example of a movement restriction section. In FIG. 5, in the left side face of the shutter accommodation section 11, a stopper surface 11*d* is formed that extends in the gravity direction and that serves as an example of a stop section. Under the stopper surface 11*d*, a toner pocket 11*e* is formed that has a shape depressed downward and extending in the front and rear directions and that serves as an example of an accommodation section for dropped developer. The width of the toner pocket 11*e* in the front and rear directions according to Exemplary Embodiment 1 is formed longer than the width of the later-described outlet of the toner cartridge TC in the front and rear directions.

In FIGS. 5 to 9B, in the left part of the barrel wall 3*b*, a projected rim accommodation recess 12 is formed that has an arc shape depressed leftward relative to the inner peripheral surface 3*c* of the barrel wall 3*b*, that is, outward in the radial direction of the barrel wall 3*b*, and that serves as an example of an accommodation section for a projected rim.

Figure 10A:
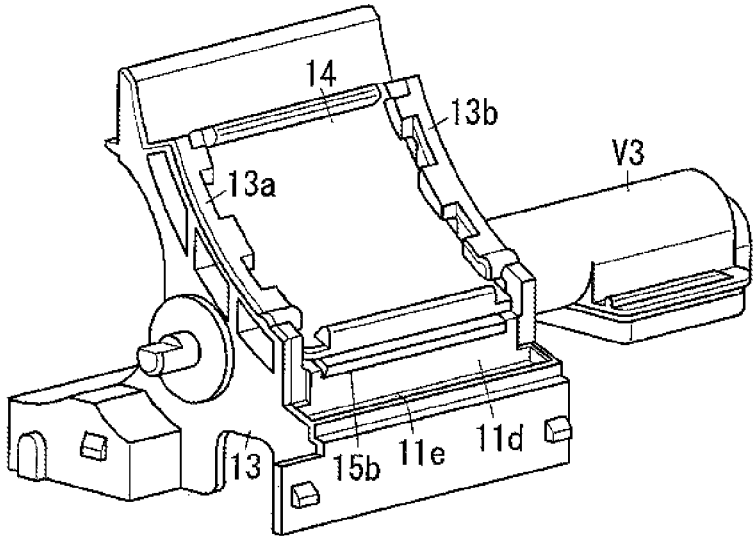
FIGS. 10A and 10B are explanation diagrams showing a main part of an inlet section according to Exemplary Embodiment 1.
Figure 10B:
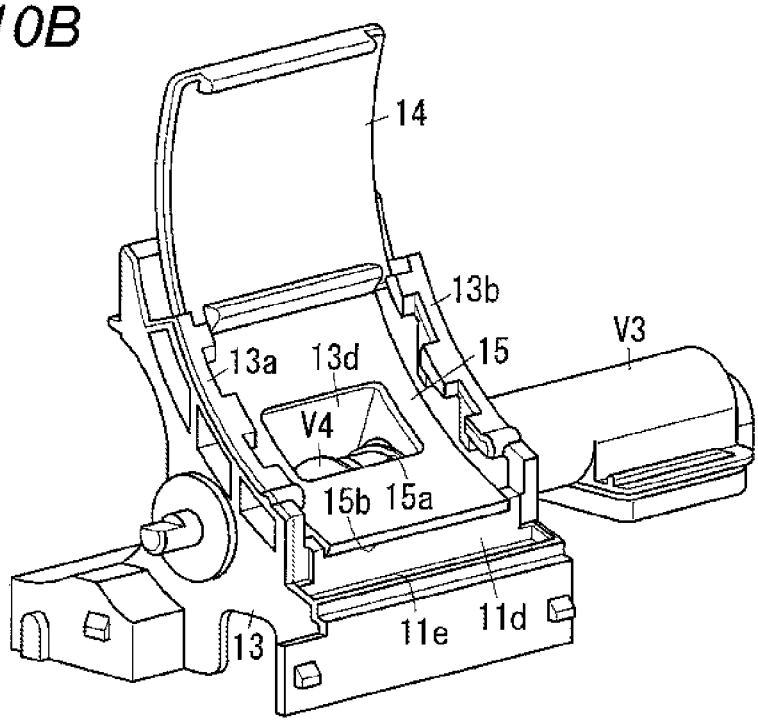

FIGS. 10A and 10B are explanation diagrams showing a main part of an inlet section according to Exemplary Embodiment 1. FIG. 10A is an explanation diagram showing a state that an inlet shutter has moved to a closed position. FIG. 10B is an explanation diagram showing a state that an inlet shutter has moved to an open position.

In FIGS. 5 and 8, between the shutter accommodation section 11 and the projected rim accommodation recess 12 in the barrel wall 3*b*, the inlet section 13 is formed that extends along the circumferential direction of the barrel wall 3*b*. In FIGS. 5, 10A and 10B, in the inlet section 13, a pair of front and rear shutter guides 13*a* and 13*b* are formed that serve as an example of guide members. Between the shutter guides 13*a* and 13*b*, an inlet shutter 14 serving as an example of an inlet opening and closing member is supported in a movable manner along the circumferential direction of the barrel wall 3*b*.

In FIGS. 5, 8, 10A and 10B, the inlet section 13 has an inflow surface 13*c* formed between the shutter guides 13*a* and 13*b* and formed in a step shape one-step lower than the inner peripheral surface 3*c* of the barrel wall 3*b* and one-step higher than the upper face of the recess 11*a* of the shutter accommodation section 11.

In FIGS. 8 to 10B, in the inflow surface 13*c*, an inlet 13*d* is formed. In the inlet section 13, an inflow path 13*e* is formed that extends downward from the inlet 13*d*. The lower end of the inflow path 13*e* is connected to the upstream end of the developer supply path V3.

Figure 11A:
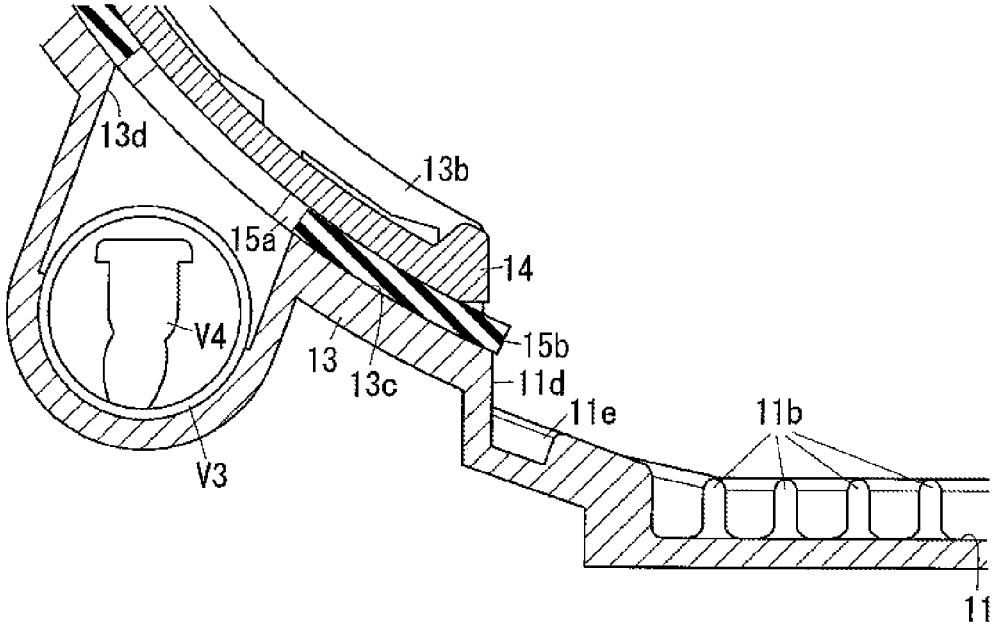
FIGS. 11A and 11B are enlarged views of a main part of an end part of an inlet seal according to Exemplary Embodiment 1.
Figure 11B:
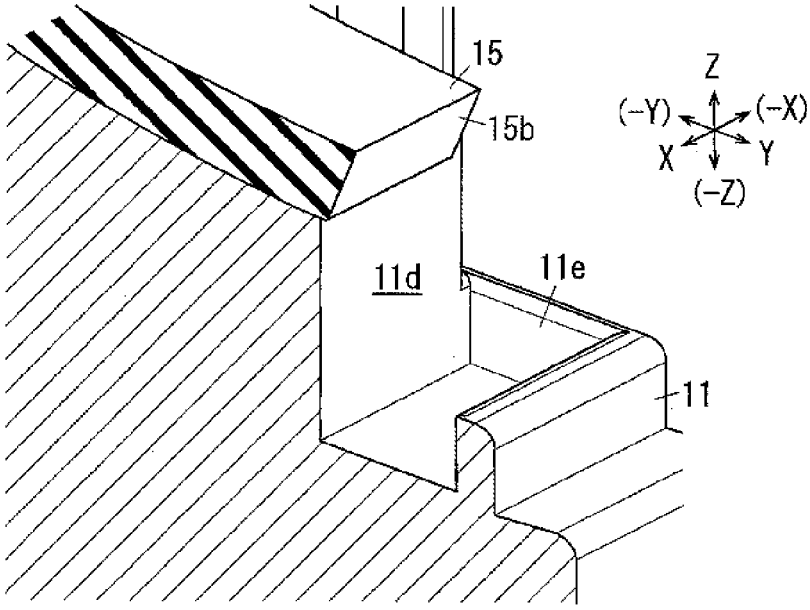

FIGS. 11A and 11B are enlarged views of a main part of an end part of an inlet seal according to Exemplary Embodiment 1. FIG. 11A is a sectional view. FIG. 11B is a perspective sectional view.

In FIGS. 9A, 9B, 10A, 10B, 11A, 11B, in the upper face of the inflow surface 13*c*, an inlet seal 15 is supported in which an opening 15*a* corresponding to the inlet 13*d* is formed and which serves as an example of a first leakage preventing member. The inlet seal 15 according to Exemplary Embodiment 1 is constructed from polyurethane rubber serving as an example of elastic material, then suffers elastic deformation by being pinched between the inflow surface 13*c* and the inlet shutter 14, and then closes the gap between the inflow surface 13*c* and the inlet shutter 14 so as to prevent leakage of developer. In FIGS. 11A and 11B, the right end part of the inlet seal 15 according to Exemplary Embodiment 1 is set up in a length protruding from the stopper surface 11*d* in the right direction. Further, the right end surface 15*b* of the inlet seal 15 serving as an example of a first inclined surface is formed in an inclined manner relative to the gravity direction and is constructed from an inclined surface inclined downward left. Here, the right end surface 15*b* according to Exemplary Embodiment 1 is formed in an inclined manner relative to the gravity direction and the radial direction of the cylinder surface 3*b*.

In FIGS. 5 to 8, in the cartridge accommodation section 3, a motor support plate 16 is supported that extends leftward and serves as an example of a drive support member. On the motor support plate 16, a cartridge motor 17 is supported that serves as an example of a driving source. Under the motor support plate 16, a gear wheel support section 18 is formed that serves as an example of a transmission system support section. The gear wheel support section 18 supports a train of gear wheels, that is, a so-called gear train, that has a plurality of gear wheels (not shown) for transmitting the driving from the cartridge motor 17 to the drive coupling 4, the supply auger V4, and the like.

(Explanation of Toner Cartridge)

Figure 12A:
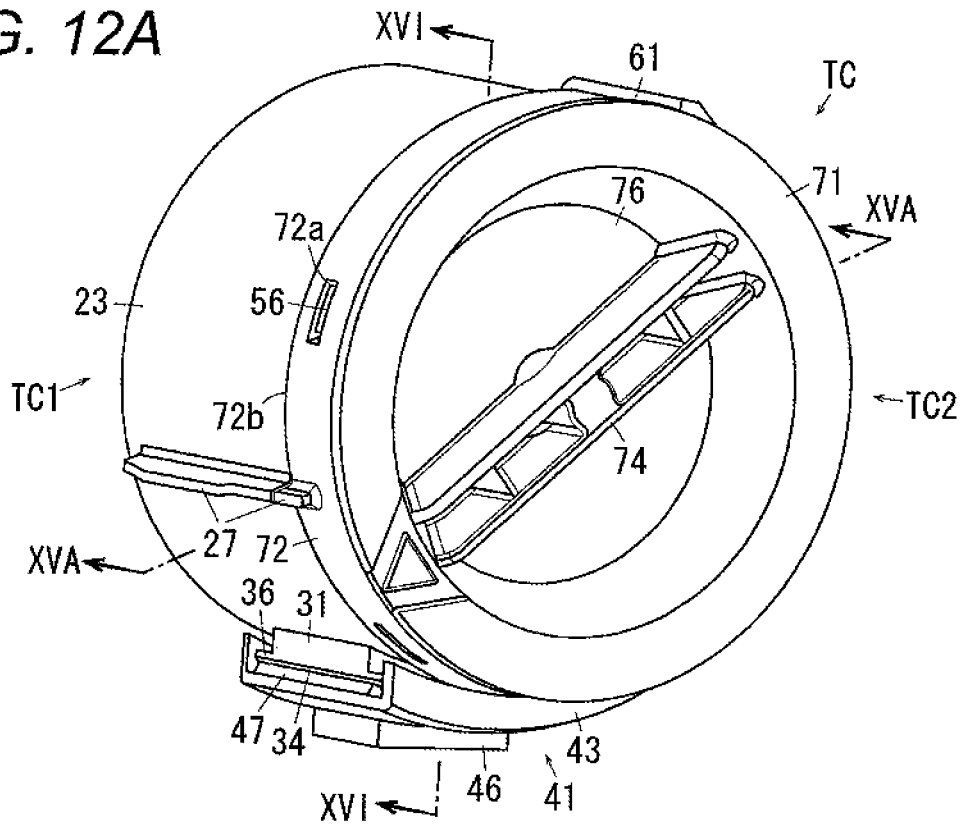
FIGS. 12A and 12B are explanation diagrams of a toner cartridge according to Exemplary Embodiment 1.
Figure 12B:
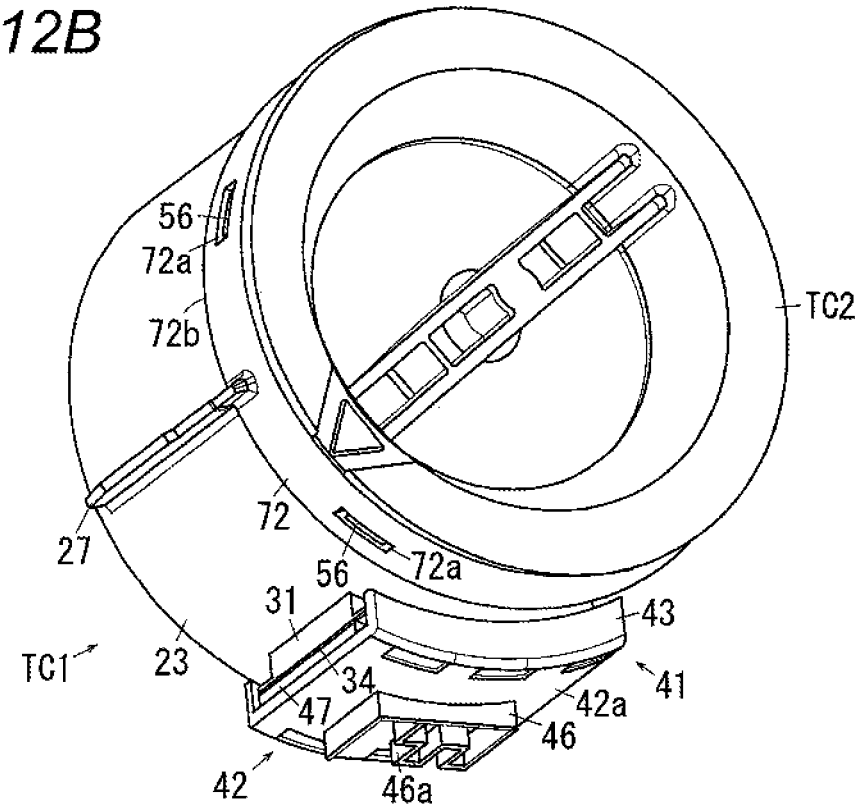

FIGS. 12A and 12B are explanation diagrams of a toner cartridge according to Exemplary Embodiment 1. FIG. 12A is a perspective view looked obliquely from left above. FIG. 12B is a perspective view looked obliquely from left below.

Figure 13:
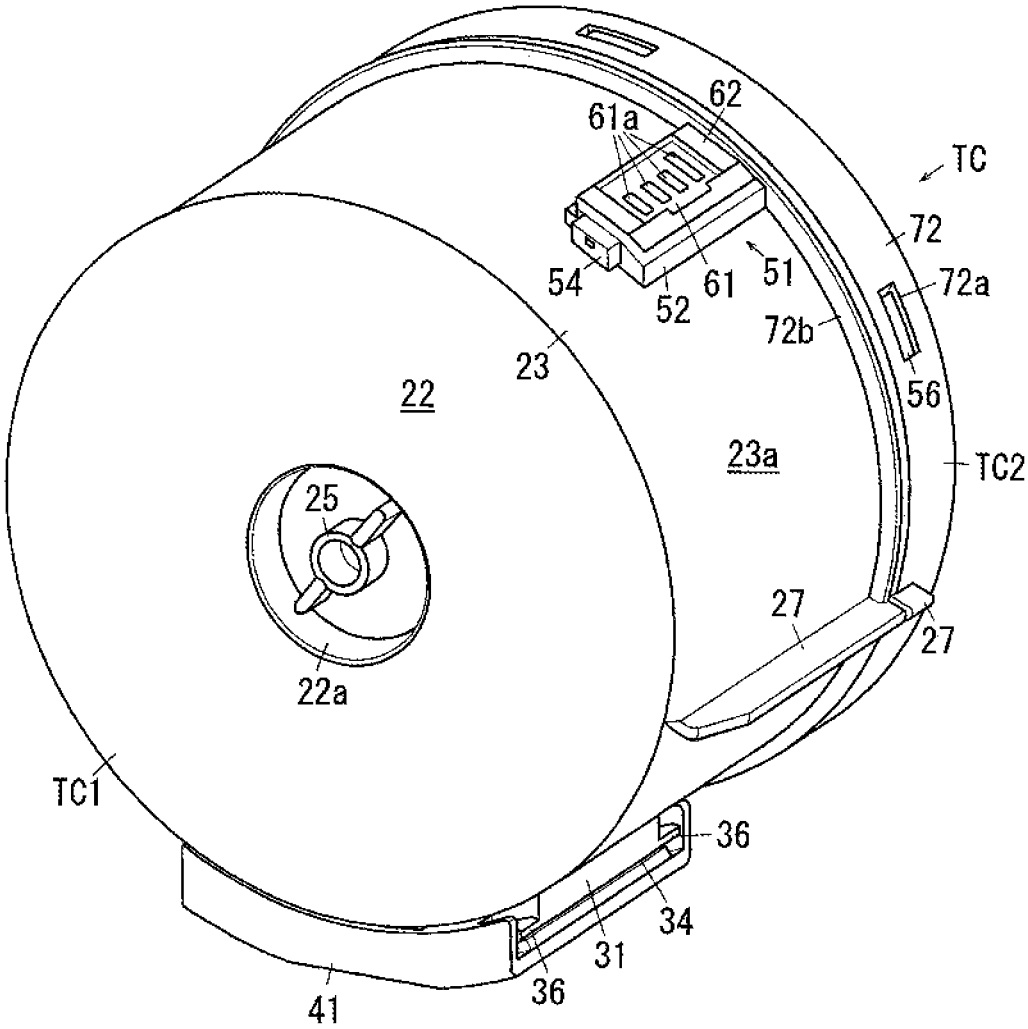
FIG. 13 is a perspective view of a toner cartridge looked obliquely from a rear side.

FIG. 13 is a perspective view of a toner cartridge looked obliquely from a rear side.

Figure 14A:
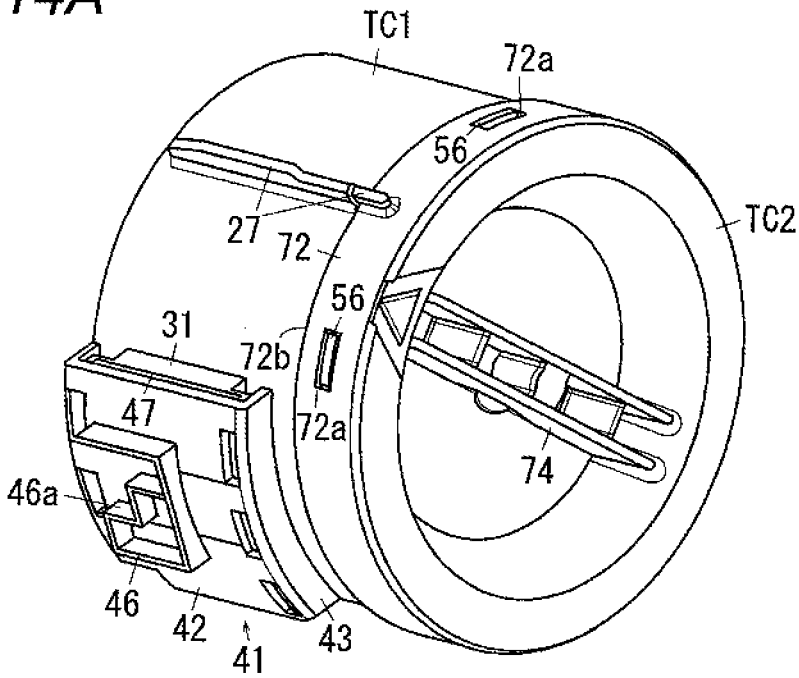
FIGS. 14A and 14B are explanation diagrams showing open and close operation of a shutter of a toner cartridge according to Exemplary Embodiment 1.
Figure 14B:
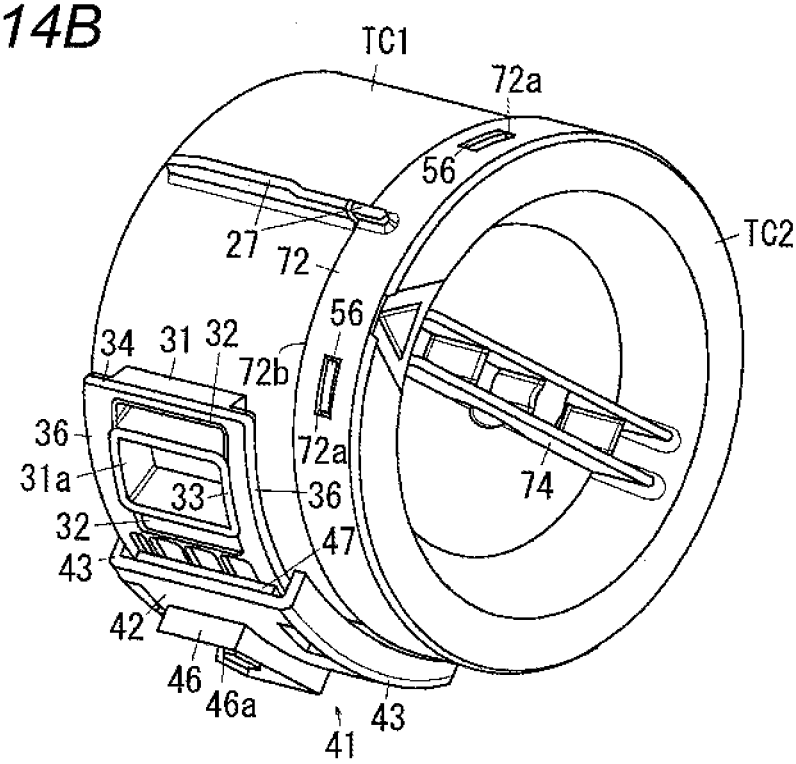

FIGS. 14A and 14B are explanation diagrams showing open and close operation of a shutter of a toner cartridge according to Exemplary Embodiment 1. FIG. 14A is an explanation diagram showing a state that a shutter of a toner cartridge has moved to a closed position. FIG. 14B is an explanation diagram showing a state that a shutter of a toner cartridge has moved to an open position.

Figure 15A:
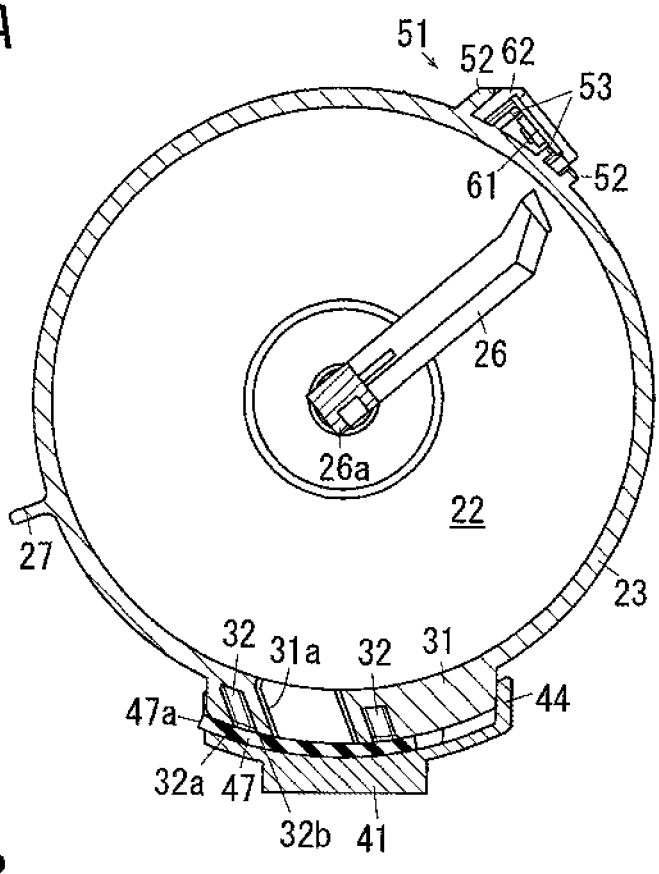
FIGS. 15A and 15B are sectional views of a main part of a toner cartridge according to Exemplary Embodiment 1.
Figure 15B:
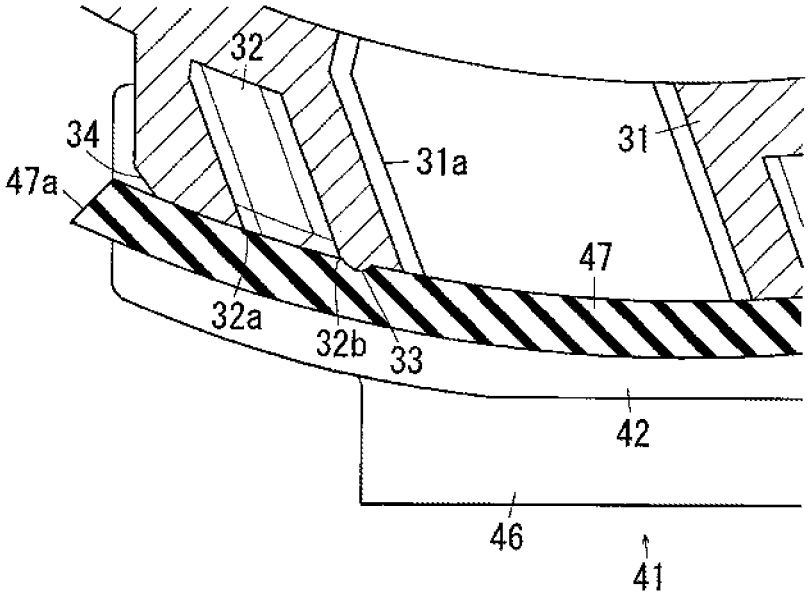

FIGS. 15A and 15B are sectional views of a main part of a toner cartridge according to Exemplary Embodiment 1. FIG. 15A is a sectional view taken along line XVA-XVA in FIG. 12A. FIG. 15B is an enlarged view of a main part of an outlet part in FIG. 15A.

Figure 16:
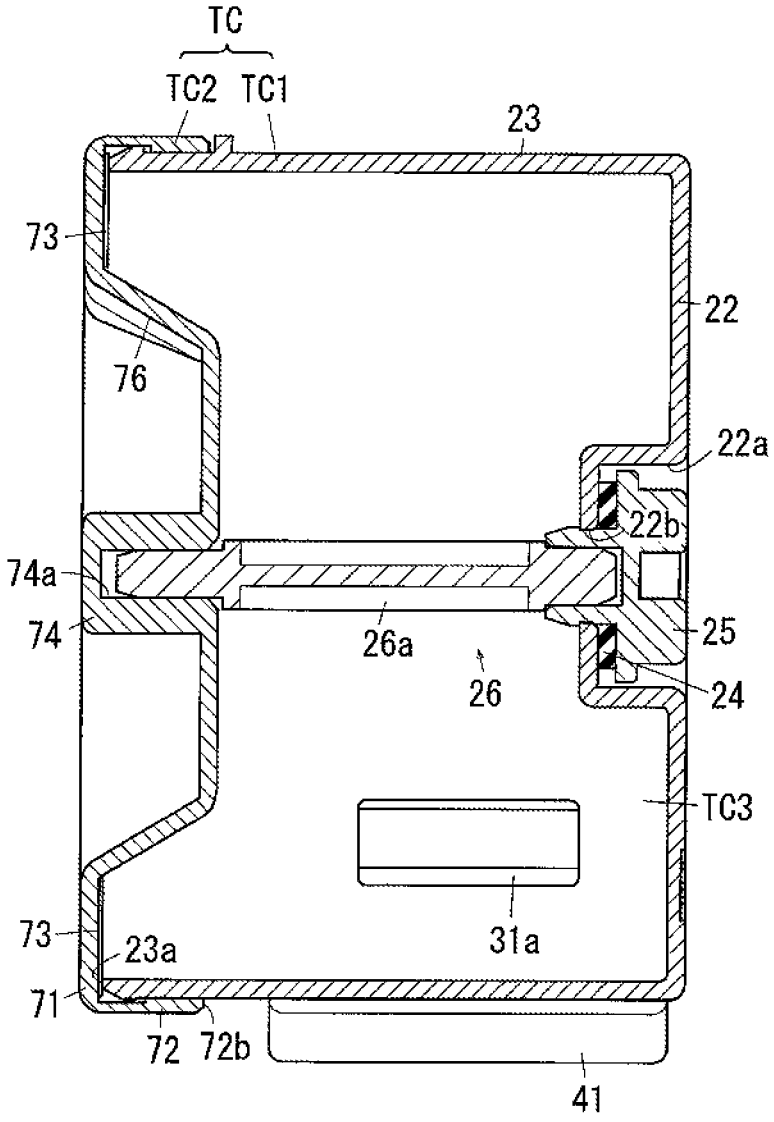
FIG. 16 is a sectional view of a main part of a toner cartridge according to Exemplary Embodiment 1, which is a sectional view taken along line XVI-XVI in FIG. 12A.

FIG. 16 is a sectional view of a main part of a toner cartridge according to Exemplary Embodiment 1, which is a sectional view taken along line XVI-XVI in FIG. 12A.

In FIGS. 5 to 16, the toner cartridge TC attached to and detached from the cartridge holder KH has: a cylindrical cartridge body TC1 that has a rotating shaft extending in the front and rear directions equal to the insertion direction, that is, the attaching and detaching directions, and that serves as an example of a container body for developer and as an example of a main body of an attaching and detaching body; and a cartridge cover TC2 that closes the front end of the cartridge body TC1 and that serves as an example of a lid member.

The cartridge body TC1 has a barrel section 22+23 constructed from: a disk-shaped rear end wall 22 serving as an example of a bottom wall formed in the front part of the insertion direction, that is, at the rear end in the front and rear directions; and a barrel wall 23 extending forward from the rear end wall 22. In FIG. 16, at the front end of the toner cartridge body TC1, an opening 23*a* is formed that is closed by the cartridge cover TC2. Then, the space surrounded by the toner cartridge TC1 and the cartridge cover TC2 constructs an interior space TC3 of the toner cartridge TC that accommodates new developer to be supplied to the developing apparatus G and that serves as an example of a developer accommodation section.

In FIGS. 13 and 16, in the center part of the rear end wall 22, a transmission accommodation section 22*a* is formed that has a cylindrical shape depressed frontward. In the transmission accommodation section 22*a*, an opening 22*b* is formed that goes through in the front and rear directions. In FIG. 16, in the transmission accommodation section 22*a*, a follower coupling 25 that engages with the drive coupling 4 and that serves as an example of a to-be transfer member is supported by the opening 22*b* in a rotatable manner via a coupling seal 24 serving as an example of a leakage preventing member. When the toner cartridge TC is attached to the cartridge holder KH, the follower coupling 25 engages with the drive coupling 4 so as to transmit the driving.

In FIG. 16, the interior space TC3 of the toner cartridge TC, a cartridge auger 26 is arranged that stirs and conveys developer to an outlet 31*a* described later and that serves as an example of a conveyance member. The cartridge auger 26 has a shaft 26*a* extending in the front and rear directions. The rear end of the shaft 26*a* is supported by the follower coupling 25.

In the outer surfaces of the cartridge body TC1 and the cartridge cover TC2, a rib 27 is formed that protrudes outward in the radial direction and extends in the front and rear directions and that serves as an example of a projected rim section and as an example of a linkage closing part. The rib 27 according to Exemplary Embodiment 1 is formed in correspondence to the projected rim accommodation recess 12, then accommodated into the projected rim accommodation recess 12 in a state that the toner cartridge TC is attached to the cartridge accommodation section 3, and then goes into a state of being adjacent to the upper left end face of the inlet shutter 14 as shown in FIGS. 9A and 9B.

In FIGS. 9A, 9B and 12A to 15B, at the lower end of the barrel wall 23, an outlet section 31 is formed that protrudes downward, that is, outward in the radial direction, from the outer peripheral surface 23*a* of the barrel wall 23 in correspondence to the shutter accommodation section 11. In FIGS. 8 and 13, in the outlet section 31, an outlet 31*a* is formed that connects the inner surface and the outer surface of the barrel wall 23 and that serves as an example of an outlet. The outlet 31*a* is connected to the inlet 13*d* at an attached position shown in FIG. 9B. The outlet 31*a* according to Exemplary Embodiment 1 is formed in an inclined manner downward relative to the radial direction of the barrel wall 23 as shown in FIGS. 9A, 9B, 15A and 15B. Then, in an attached position shown in FIG. 9B, the inclination angle is such that the outlet 31*a* is near the down direction of the gravity direction. Thus, in comparison with a case that the inclination angle is near the horizontal level, that is, the inclination angle is shallow, developer flowing out through the outlet 31*a* becomes hardly adhered to and deposited on the wall surface of the outlet 31*a*. This alleviates clogging.

In FIGS. 9A, 9B, 14B, 15A and 15B, in the outlet section 31 according to Exemplary Embodiment 1, collection grooves 32 that extend inward in the radial direction and that serve as an example of recesses are formed on both sides of the outlet 31*a* along the circumferential direction of the barrel section 22+23. The collection grooves 32 according to Exemplary Embodiment 1 extend in a direction inclined in the clockwise direction as going inward in the radial direction in FIGS. 9A, 9B and 15B. Thus, in the outer edge of the collection grooves 32, in the downstream section 32*a* in the clockwise direction, the angle relative to the outer peripheral surface 31*b* of the outlet section 31 is set to be an acute angle. Further, in the upstream section 32*b* in the clockwise direction, the angle relative to the outer peripheral surface 31*b* is set to be an obtuse angle. Here, in Exemplary Embodiment 1, the width of the collection grooves 32 in the front and rear directions is formed greater than the width of the outlet 31*a* in the front and rear directions so that the entire range of the width of the outlet 31*a* in the front and rear directions can be covered.

In FIGS. 9A, 9B, 14B, 15A and 15B, in the outlet section 31 according to Exemplary Embodiment 1, a protruding frame 33 is formed that protrudes outward in the radial direction in comparison with the outer peripheral surface 31*b*, in a manner surrounding the rim of the outlet 31*a*. Thus, in the toner cartridge TC according to Exemplary Embodiment 1, the outer edges 32*a* and 32*b* of the collection grooves 32 are arranged inward in the radial direction in comparison with the outer edge of the protruding frame 33.

In FIG. 15B, in the outlet section 31 according to Exemplary Embodiment 1, a seal guide surface 34 that is inclined inward in the radial direction as going downstream and that serves as an example of a leakage guide section is formed at the end of the downstream in the clockwise direction. That is, the downstream edge of the outlet section 31 in the circumferential direction is formed in a so-called chamfered shape. Further, in both edges of the outlet 31*a* in the circumferential direction and in both edges of the collection grooves 32 in the circumferential direction, a guide surface having a chamfered shape is formed similarly to that of the seal guide surface 34.

In FIGS. 12A to 15B, in the outlet section 31 according to Exemplary Embodiment 1, a cartridge shutter guide 36 that has a shape protruding outward in the front and rear directions and extends along the circumferential direction of the barrel wall 23 and that serves as an example of an opening and closing guide member is formed in both edges in the front and rear directions.

In FIGS. 5, 9A, 9B and 12A to 15B, in the outlet section 31, a cartridge shutter 41 is supported that opens and closes the outlet 31*a* and that serves as an example of an opening and closing member. The cartridge shutter 41 has a shutter body 42 having the shape of a partial barrel wall extending along the outer peripheral surface 31*b* of the outlet section 31. The length of the shutter body 42 in the circumferential direction is set up in correspondence to the length of the shutter accommodation section 11. In both edges of the shutter body 42 in the front and rear directions, a side wall 43 extending upward is formed. In the side wall 43, a to-be guided section (not shown) is formed that is supported in a movable manner in a state of contacting the upper face of the cartridge shutter guide 36. Thus, the cartridge shutter 41 is supported in a manner movable between a closed position where the outlet 31*a* is closed as shown in FIG. 14A and an open position where the outlet 31*a* is opened as shown in FIG. 14B.

In FIGS. 9A, 9B and 15A, in the right end section of the shutter body 42, a right wall 44 is formed that extends upward and that serves as an example of a to-be restricted section. Then, in a state that the toner cartridge TC is attached to the cartridge holder KH, in a situation that the right wall 44 is opposed to the backlash stuffing section 11*c*, when the toner cartridge TC is rotated, in particular, when the cartridge is moved from a locked position serving as an example of an attached position as shown in FIG. 9B to an unlocked position serving as an example of a detachable position as shown in FIG. 9A, the right wall 44 contacts with the backlash stuffing section 11*c* so that the amount of movement s of the cartridge shutter 41 in the right and left directions, that is, the movement referred to as so-called allowance or backlash, is reduced in comparison with a case that the backlash stuffing section 11*c* is not provided.

In FIG. 12B, in the outer surface 42*a* of the shutter body 42, a protrusion 46 is formed that protrudes downward in correspondence to the recess 11*a* of the shutter accommodation section 11. In FIG. 12B, in the protrusion 46, a cartridge-side hardkey 46*a* is formed that is constructed from a recess extending in the front and rear directions in correspondence to the hardkey 11*b* on the body side and that serves as an example of a to-be identified section. Thus, when the number and the length of the hardkey 11*b* on the body side agree with the shape of the recesses of the hardkey 46*a* on the cartridge side, the hardkeys 11*b* and 46*a* do not interfere with each other so that the toner cartridge TC is attached and then the toner cartridge TC is identified as one suitable to the printer U. In contrast, when the number and the length of the hardkey 11*b* on the body side do not agree with the shape of the recesses of the hardkey 46*a* on the cartridge side, the hardkeys 11*b* and 46*a* interfere with each other so that the toner cartridge TC cannot be inserted to the end and hence the toner cartridge TC is identified as one not suitable to the printer U.

In FIGS. 9A, 9B, 15A and 15B, between the shutter body 42 and the outlet sections 31, an outlet seal 47 is arranged that prevents leakage of developer from the outlet 31*a* and that serve as an example of a second leakage preventing member. The outlet seal 47 according to Exemplary Embodiment 1 is supported in a state of being stuck on the inner surface of the shutter body 42. The outlet seal 47 according to Exemplary Embodiment 1 is constructed from polyurethane rubber serving as an example of elastic material. The upper face of the outlet seal 47 is set at a height corresponding to the upper face of the inlet seal 15 in a state that the toner cartridge TC is attached to the cartridge holder KH.

In FIG. 15B, in, the thickness of the outlet seal 47 is set up such that when the cartridge shutter 41 is moved to a closed position, the outlet seal 47 contacts with the outlet section 31 in an elastically deformed state. Thus, the outlet 31*a* and the collection grooves 32 are sealed so that leakage of developer is prevented.

In FIG. 15B, in the outlet seal 47 according to Exemplary Embodiment 1, its length of the circumferential direction is set up such that the edge in the circumferential direction, that is, the left end protrudes leftward in comparison with the left end of the cartridge shutter 41. Further, the left end surface 47*a* of the outlet seal 47 according to Exemplary Embodiment 1 is formed in an inclined manner relative to the gravity direction, and is constructed from an inclined surface that is inclined downward left in correspondence to the right end surface 15*b* of the inlet seal 15 and that serves as an example of a second inclined surface. Here, the left end surface 47*a* according to Exemplary Embodiment 1 is formed in an inclined manner relative to the gravity direction and the radial direction of the barrel wall 23.

Further, in the seals 15 and 47 according to Exemplary Embodiment 1, the total length along the circumferential direction in a free length state without elastic deformation is set up sufficiently longer than the length in the circumferential direction in a state that the toner cartridge TC is attached so that the right wall 44 of the cartridge shutter 41 and the backlash stuffing section 11*c* are in contact with each other. That is, in a state that the toner cartridge TC is attached to the cartridge holder KH, the end faces 15*b* and 47*a* of the seals 15 and 47 contact with each other in a state that elastic deformation occurs so that the lengths in the circumferential direction are reduced. Thus, a gap is not formed between the seals 15 and 47.

Figure 17A:
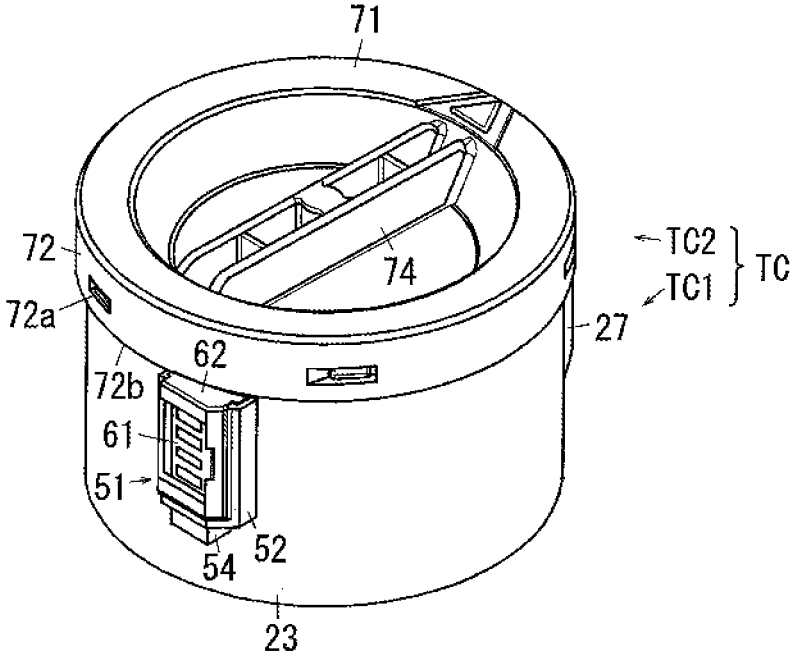
FIGS. 17A and 17B are explanation diagrams showing a main part of a storage medium part of a toner cartridge according to Exemplary Embodiment 1.
Figure 17B:
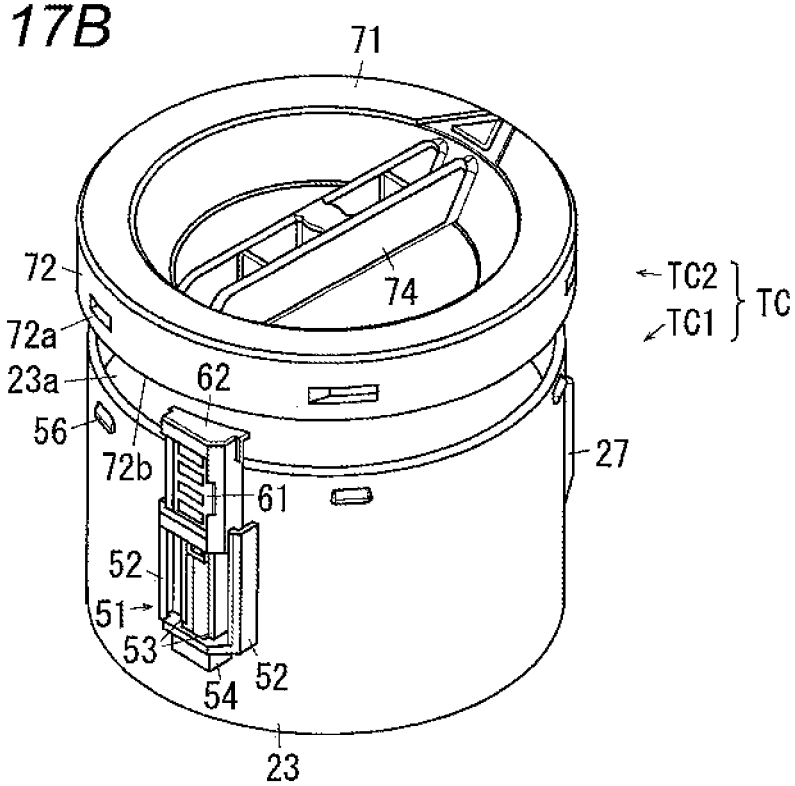

FIGS. 17A and 17B are explanation diagrams showing a main part of a storage medium part of a toner cartridge according to Exemplary Embodiment 1. FIG. 17A is a perspective explanation diagram showing a state that a cartridge cover is attached. FIG. 17B is a perspective explanation diagram showing a state that a cartridge cover is removed.

Figure 18A:
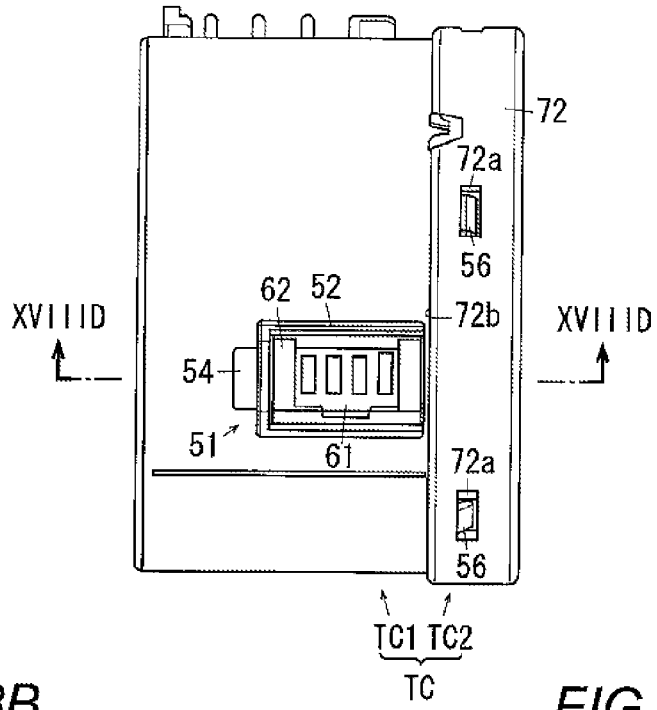
FIGS. 18A to 18D are explanation diagrams showing a main part of a storage medium part of a toner cartridge.
Figure 18B:
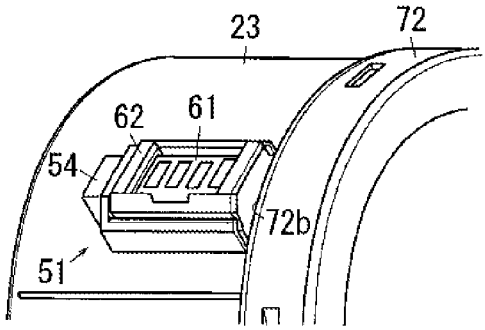
Figure 18C:
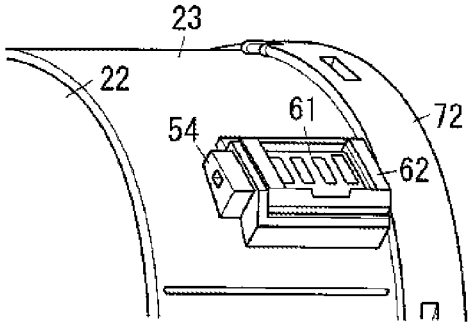
Figure 18D:
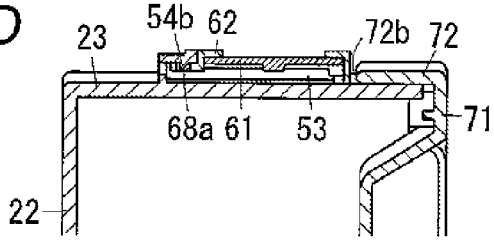

FIGS. 18A to 18D are explanation diagrams showing a main part of a storage medium part of a toner cartridge. FIG. 18A is a side view. FIG. 18B is an explanation diagram looked obliquely from a left front side. FIG. 18C is an explanation diagram looked obliquely from a left rear side. FIG. 18D is a sectional view taken along line XVIIID-XVIIID in FIG. 18A.

Figure 19A:
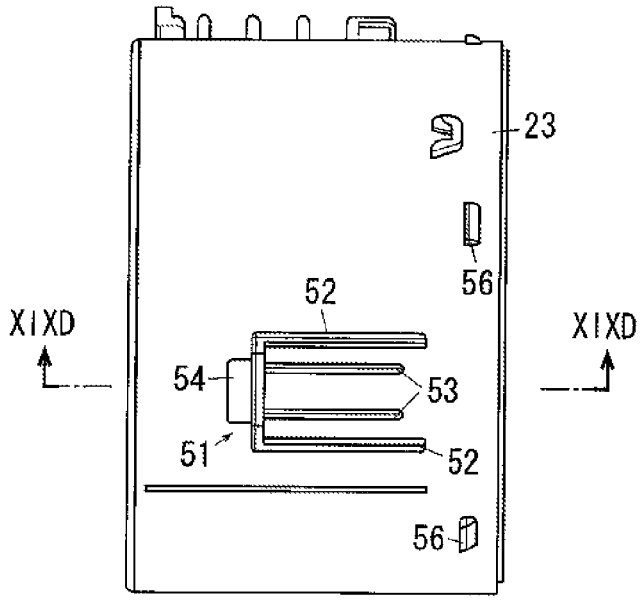
FIGS. 19A to 19D are explanation diagrams showing a main part of a storage medium support section of a cartridge body.
Figure 19B:
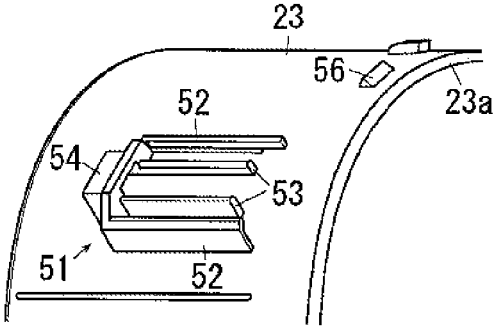
Figure 19C:
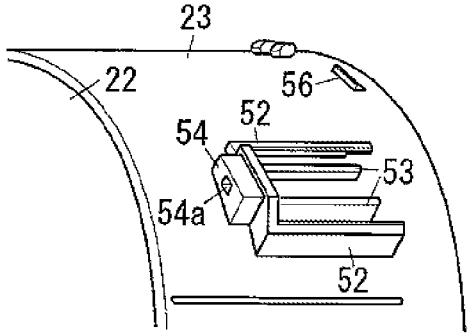
Figure 19D:
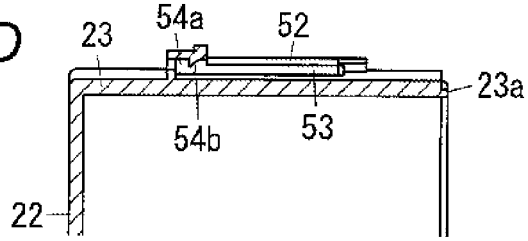

FIGS. 19A to 19D are explanation diagrams showing a main part of a storage medium support section of a cartridge body. FIG. 19A is a side view. FIG. 19B is an explanation diagram looked obliquely from a left front side. FIG. 19C is an explanation diagram looked obliquely from a left rear side. FIG. 19D is a sectional view taken along line XIXD-XIXD in FIG. 19A.

In FIGS. 9A, 9B, 13 and 17A to 19D, in the outer surface of the cartridge body TC1, a CRUM support section 51 serving as an example of a support section for a storage medium is supported in correspondence to the CRUM reader 9. In FIGS. 17B, 18A to 18D and 19A to 19D, the CRUM support section 51 has a pair of guide rails 52 that are arranged on both outer sides in the circumferential direction and extend in the front and rear directions and that serve as an example of a first guide section. Between the guide rails 52, a guide rib 53 is arranged that is constructed from a projected rim extending in the front and rear directions and that serves as an example of a second guide section. Further, on the rear side of the guide rails 52 and guide rib 53, a snap fit fix section 54 serving as an example of a fix section is arranged. As shown in FIGS. 18D and 19D, the snap fit fix section 54 has: a through-hole opening 54*a* going through in the front and rear directions; and a fix claw 54*b* that has the shape of a claw extending toward the inside of the through-hole opening 54*a* and that serves as an example of a fix section body.

In FIGS. 17A to 19D, in the outer surface of the front end part of the cartridge body TC1, claws 56 that protrudes outward and that serves as an example of a fix section for a restriction body are arranged in the circumferential direction at intervals set up in advance.

Figure 20E:
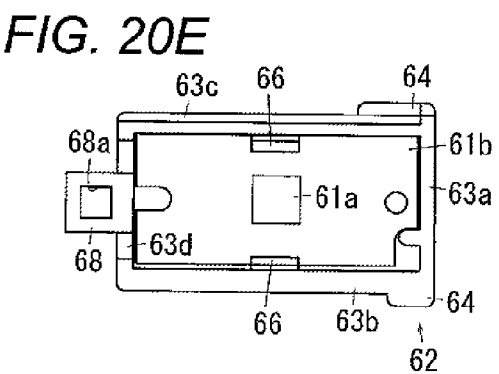
FIGS. 20A to 20F are explanation diagrams of a storage medium.
Figure 20C:
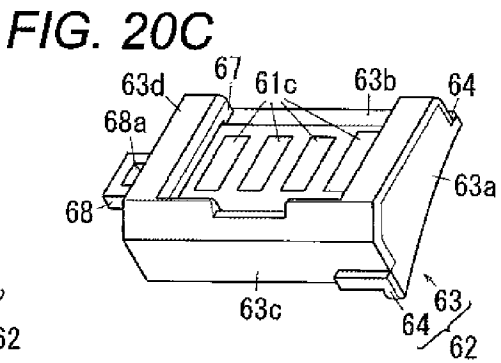
Figure 20A:
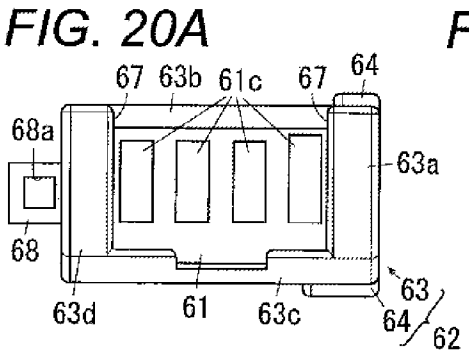
Figure 20F:
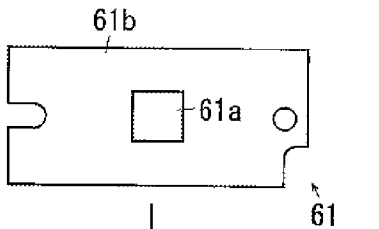
Figure 20D:
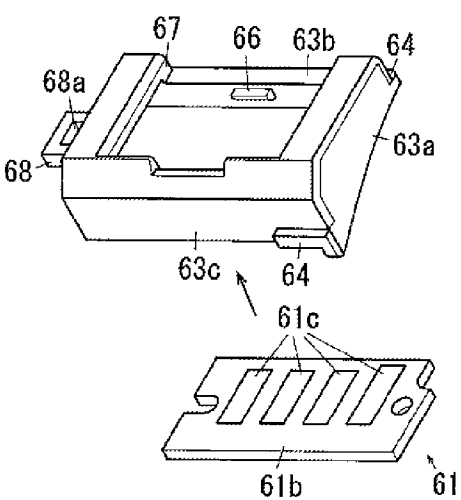
Figure 20B:
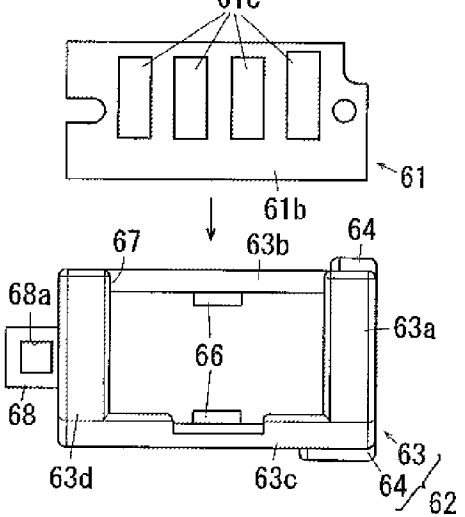

FIGS. 20A to 20F are explanation diagrams of a storage medium. FIG. 20A is a side view showing a state that a storage medium is supported by an accommodation body. FIG. 20B is a side view showing a state that a storage medium is removed from an accommodation body. FIG. 20C is an explanation diagram showing a state that a storage medium is supported by an accommodation body, which is looked obliquely from a front side. FIG. 20D is an explanation diagram showing a state that a storage medium is removed from an accommodation body, which is looked obliquely from a front side. FIG. 20E is a view looked from a back face side in FIG. 20A. FIG. 20F is a view looked from a back face side in FIG. 20B.

In FIGS. 17A to 20F, in the CRUM support section 51, a CRUM 61 serving as an example of a storage medium is supported in an attachable and detachable manner. The CRUM 61 according to Exemplary Embodiment 1 has: a flat-plate shaped board 61*b* on which an electrical circuit element 61*a* such as a storage element is arranged; and a terminal section 61*c* formed in the outer surface of the board 61*b* in correspondence to the connector 9*a* of the CRUM reader 9. When the terminal section 61*c* contacts with the connector 9*a* of the CRUM reader 9, transmission and reception of information becomes available. Thus, information concerning the toner cartridge TC stored in the element 61*a*, for example, information on whether developer is empty and information on the number of times of rotation of the cartridge auger 26 can be read and written.

The CRUM 61 according to Exemplary Embodiment 1 is supported by the CRUM support section 51 via a CRUM holder 62 serving as an example of an accommodation body. The CRUM holder 62 has a holder body 63 having a frame shape formed in a size that encompasses the surroundings of the board 61*b* of the CRUM 61. The holder body 63 has: a front section 63*a* on the front side; a left section 63*b* and a right section 63*c* extending rearward from the left and right ends of the front section 63*a*; and a rear section 63*d* for connecting the rear ends of the left section 63*b* and the right section 63*c*. In the outer surfaces of the left section 63*b* and the right section 63*c*, a to-be guided section 64 is formed that protrudes outward in correspondence to the guide rails 52 and that serves as an example of a to-be guided section. The to-be guided section 64 is guided by the guide rails 52 so that the CRUM holder 62 is attachable to and detachable from the cartridge body TC1. Thus, the line of extension of the guide rails 52 is equal to the locus of movement of the CRUM holder 62. Here, in Exemplary Embodiment 1, the to-be guided section 64 is formed in the front side part of the CRUM holder 62. Then, the length in the front and rear directions is set to be the necessary minimum.

In the inner surfaces of the left section 63*b* and the right section 63*c*, a CRUM holding section 66 that protrudes inside so as to support the rear face side of the board 61*b* of the CRUM 61 and that serves as an example of a medium holding section is formed in the center part of the front and rear directions. The right section 63*c* according to Exemplary Embodiment 1 has a height lower than the front section 63*a*, the left section 63*b*, and the rear section 63*d*.

The CRUM 61 according to Exemplary Embodiment 1 is inserted from the inner side of the CRUM holder 62, that is, the guide rib 53 side of the CRUM support section 51. At the time of insertion, when inserted further in a state of contacting with the CRUM holding section 66, the CRUM 61 is attached in a state that the CRUM holder 62 is elastically deformed. After the CRUM 61 is supported by the CRUM holding section 66, movement of the board 61*b* in the right and left directions is restricted by the left section 63*b* and the right section 63*c*. Further, the front section 63*a* and the rear section 63*d* prevents its dropping outward.

In the rear section 63*d*, a snap fit to-be fixed section 68 is formed that is formed in a plate shape protruding rearward and can be inserted into the through-hole opening 54*a* of the snap fit fix section 54 and that serves as an example of a to-be fixed section. In the snap fit to-be fixed section 68, a to-be fixed hole 68*a* into which a fix claw 54*b* locks is formed.

Thus, as shown in FIGS. 17A to 20F, the CRUM 61 is inserted from the inward and then attached to the CRUM holder 62. Further, the to-be guided section 64 is guided by the guide rails 52 and then inserted into the CRUM support section 51 from the front direction. Then, the snap fit to-be fixed section 68 and the fix claw 54*b* are elastically deformed, and then the fix claw 54*b* of the snap fit fix section 54 locks into the to-be fixed hole 68*a* of the snap fit to-be fixed section 68 so that the CRUM holder 62 is fixed to the CRUM support section 51.

In FIGS. 5 to 7, 12A, 12B, 14A, 14B, 16, 17A and 17B, the cartridge cover TC2 according to Exemplary Embodiment 1 has: a disk-shaped front wall 71; and a cover barrel section 72 that has a cylindrical shape and extends rearward from the outer periphery of the front wall 71 and that serves as an example of a barrel section. In FIG. 16, the cartridge cover TC2 according to Exemplary Embodiment 1 is attached via a cover seal 73 that is arranged between the cartridge cover TC2 and the front end of the barrel wall 23 and that serves as an example of a leakage preventing member. In the front wall 71, a handle 74 that extends in the right and left directions and that serves as an example of an operation section is formed in the front face. On both of the up and down sides of the handle 74, a handle recess 76 is formed that has the shape of a hemicircular cone depressed rearward relative to the insertion direction of the toner cartridge TC and that is used by an operator for griping with fingers and serves as an example of an operation recess.

In FIG. 16, in the center part of the handle 74, a pivot section 74*a* is formed that has the shape of a circular hole depressed frontward from the rear face relative to the insertion direction of the toner cartridge TC and that serves as an example of a shaft support section. Then, the front end of the shaft 26*a* of the cartridge auger 26 is supported in a rotatable manner.

In FIGS. 17A, 17B and 18A to 18D, in the cover barrel section 72 of the cartridge cover TC2 according to Exemplary Embodiment 1, a fix opening 72*a* serving as an example of a to-be fixed section for a restriction body is formed at a position corresponding to the claw 56. Further, at the rear end of the cover barrel section 72 of the cartridge cover TC2 according to Exemplary Embodiment 1, a ring-shaped dropping prevention section 72*b* is formed that is arranged adjacent and opposed to the front side of the CRUM holder 62 and can restrict the movement in the front direction of the CRUM holder 62, that is, in the direction of dropping, and that serves as an example of a restriction body.

(Operation According to Exemplary Embodiment 1)

In the printer U having the above-mentioned configuration according to Exemplary Embodiment 1, when the toner cartridge TC is to be attached to the cartridge holder KH, in a state that the positions of the outlet section 31 and the cartridge shutter 41 are aligned with the position of the shutter accommodation section 11, the toner cartridge TC is inserted into the cartridge holder KH, and then moved from a detaching position shown in FIG. 5 to an unlocked position serving as an example of a detachable position shown in FIG. 6.

At that time, when the toner cartridge TC is one suitable to the printer U, the hardkey 46*a* on the cartridge side and the hardkey 11*b* on the body side lock to each other so that insertion is allowed. In case of an unsuitable cartridge, the hardkeys 11*b* and 46*a* interfere with each other and hence movement to an unlocked position is not allowed. That is, incorrect attachment that a toner cartridge TC not suitable to the printer U is attached erroneously is prevented.

When the toner cartridge TC inserted into the cartridge holder KH is rotated from an unlocked position shown in FIGS. 6 and 9A toward a locked position shown in FIGS. 7 and 9B, the cartridge body TC1 is rotated in a state that the cartridge shutter 41 contacts with the stopper surface 11*d* of the level difference between the shutter accommodation section 11 and the inflow surface 13*c* so that rotation is restricted and that the cartridge shutter 41 stays in the shutter accommodation section 11. That is, the cartridge shutter 41 moves relative to the outlet section 31 in the circumferential direction serving as an example of a moving direction, so as to move from a closed position shown in FIGS. 9A and 14A where the outlet 31*a* is closed to an open position shown in FIGS. 9B and 14B where the outlet 31*a* is open. Further, at that time, the inlet shutter 14 of the cartridge holder KH is pushed by the outlet section 31 that moves to a locked position, so as to move from a closed position shown in FIGS. 9A and 10A where the inlet 13*d* is closed to an open position shown in FIGS. 9B and 10B where the inlet 13*d* is open.

Thus, when the toner cartridge TC moves to a locked position serving as an example of an attached position, the outlet 31*a* and the inlet 13*d* are opened and the outlet 31*a* and the inlet 13*d* are connected to each other so that developer can be supplied.

Here, at that time, the terminal section 61*c* of the CRUM 61 supported by the toner cartridge TC contacts with the connector 9*a* of the CRUM reader 9 so that electrical connection is established. Thus, transmission and reception of information to and from the CRUM 61, that is, read and write of information become available.

When the toner cartridge TC is to be changed or alternatively when the toner cartridge TC is to be removed at the time of maintenance, inspection, or the like, the toner cartridge TC is rotated from a locked position shown in FIGS. 7, 9B, 14B, and the like toward an unlocked position shown in FIGS. 6, 9A, 14A, and the like.

At that time, the cartridge shutter 41 is held by the shutter accommodation section 11 in a state that movement in the rotation direction is not allowed. Thus, the cartridge shutter 41 moves relative to the rotated outlet section 31 so as to move to a closed position. Further, at that time, the inlet shutter 14 is pushed by the rib 27 and the like of the rotated toner cartridge TC so as to move from an open position shown in FIGS. 9B and 10B to a closed position shown in FIGS. 9A and 10A and close the inlet 13*d*. Thus, when the toner cartridge TC has moved from a locked position to an unlocked position, the individual shutters 14 and 41 move to a closed position so as to close the inlet 13*d* and the outlet 31*a*.

Then, the toner cartridge TC having moved to an unlocked position can be removed from the cartridge holder KH.

(Explanation of Relation Between Toner Cartridge Rotation and Seal)

Figures 21A, 21B, 21C, 21D, 21E, 21F:
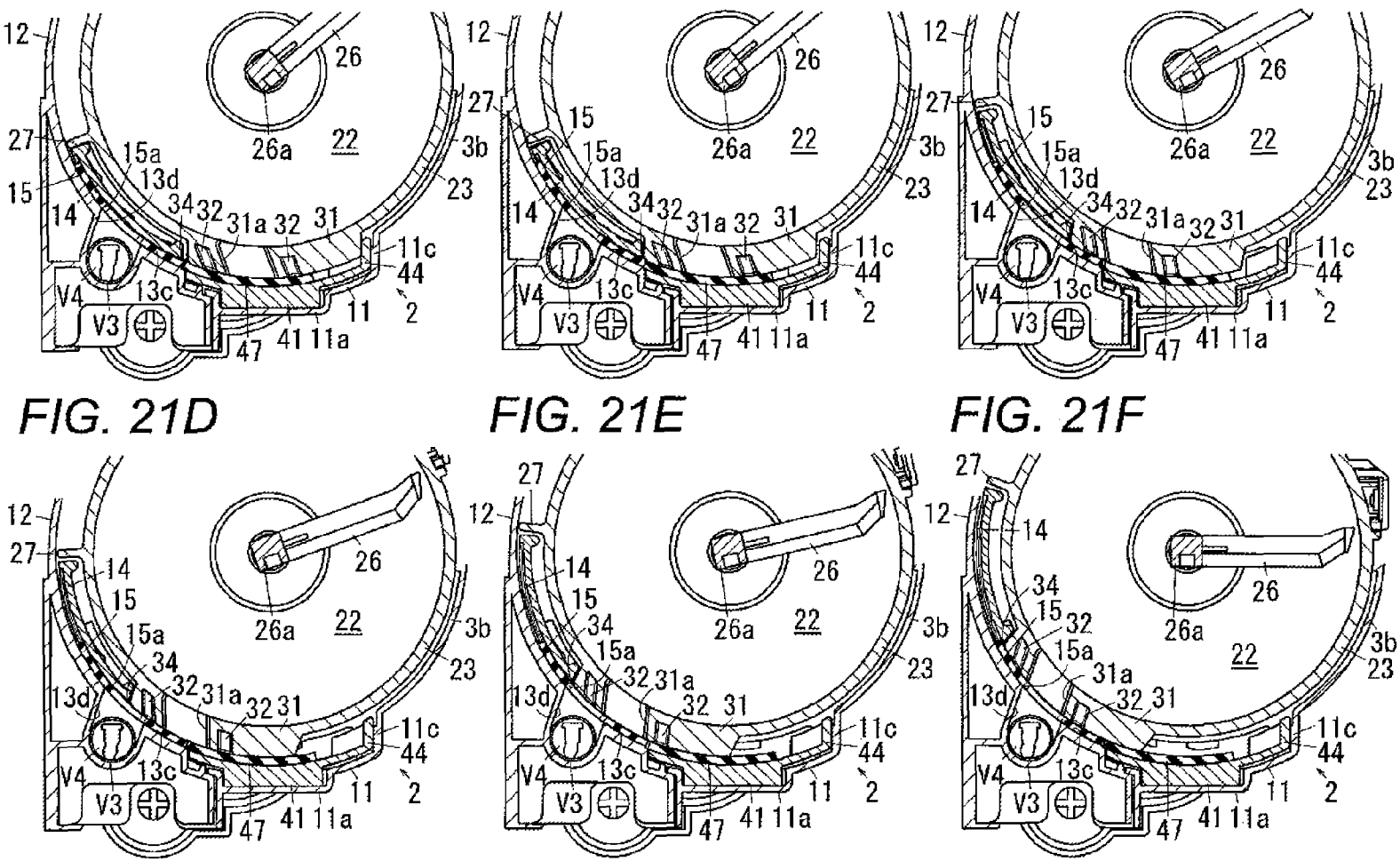
FIGS. 21A to 21F is an explanation diagram describing steps that a toner cartridge moves from an unlocked position to a locked position.

FIGS. 21A to 21F are explanation diagrams describing steps that a toner cartridge moves from an unlocked position to a locked position. FIG. 21A is an explanation diagram showing a state that a toner cartridge has moved to an unlocked position. FIG. 21B is an explanation diagram showing a state that a toner cartridge has moved from a position shown in FIG. 21A to a locked position side. FIG. 21C is an explanation diagram showing a state that a toner cartridge has moved further from a position shown in FIG. 21B to a locked position side. FIG. 21D is an explanation diagram showing a state that a toner cartridge has moved further from a position shown in FIG. 21C to a locked position side. FIG. 21E is an explanation diagram showing a state that a toner cartridge has moved further from a position shown in FIG. 21D to a locked position side. FIG. 21F is an explanation diagram showing a state that a toner cartridge has moved to a locked position side.

In FIGS. 9A, 14A, and 21A, in a state that the toner cartridge TC has moved to an unlocked position, the end faces 15*b* and 47*a* of the seals 15 and 47 mutually protruding relative to the stopper surface 11*d* and the left end of the cartridge shutter 41 contact with each other in an elastically deformed state. At that time, in the toner cartridge TC according to Exemplary Embodiment 1, the seal guide surface 34 is formed. Then, at a position where the seals 15 and 47 contact with each other, a gap is formed in the above. Thus, at the positions of the end faces of the seals 15 and 47, it is allowed that the end parts of the elastically deformed seals 15 and 47 warp upward.

In FIGS. 21A to 21C, after the toner cartridge TC begins to move from an unlocked position toward a locked position, when the seal guide surface 34 of the rotated toner cartridge TC approaches the part where the end parts of the seals 15 and 47 are deformed such as to warp upward, the seals 15 and 47 are guided and pushed downward by the seal guide surface 34 and then contact with the outer peripheral surface 31*b* of the outlet section 31. Thus, in comparison with a configuration that the seal guide surface 34 is not formed and that the edge of the outlet section 31 is not chamfered, a possibility is reduced that the seals 15 and 47 contact with the edge of the outlet section 31 so as to suffer damage. This enhances the lifetime. In FIGS. 21D to 21F, similarly, at the time that the outlet 31*a* and the collection grooves 32 pass through the position where the seals 15 and 47 contact with each other, the guide surface of the end part guides the seals 15 and 47 such as to be depressed downward, so that breakage is reduced.

Figures 22A, 22B, 22C, 22D, 22E, 22F:
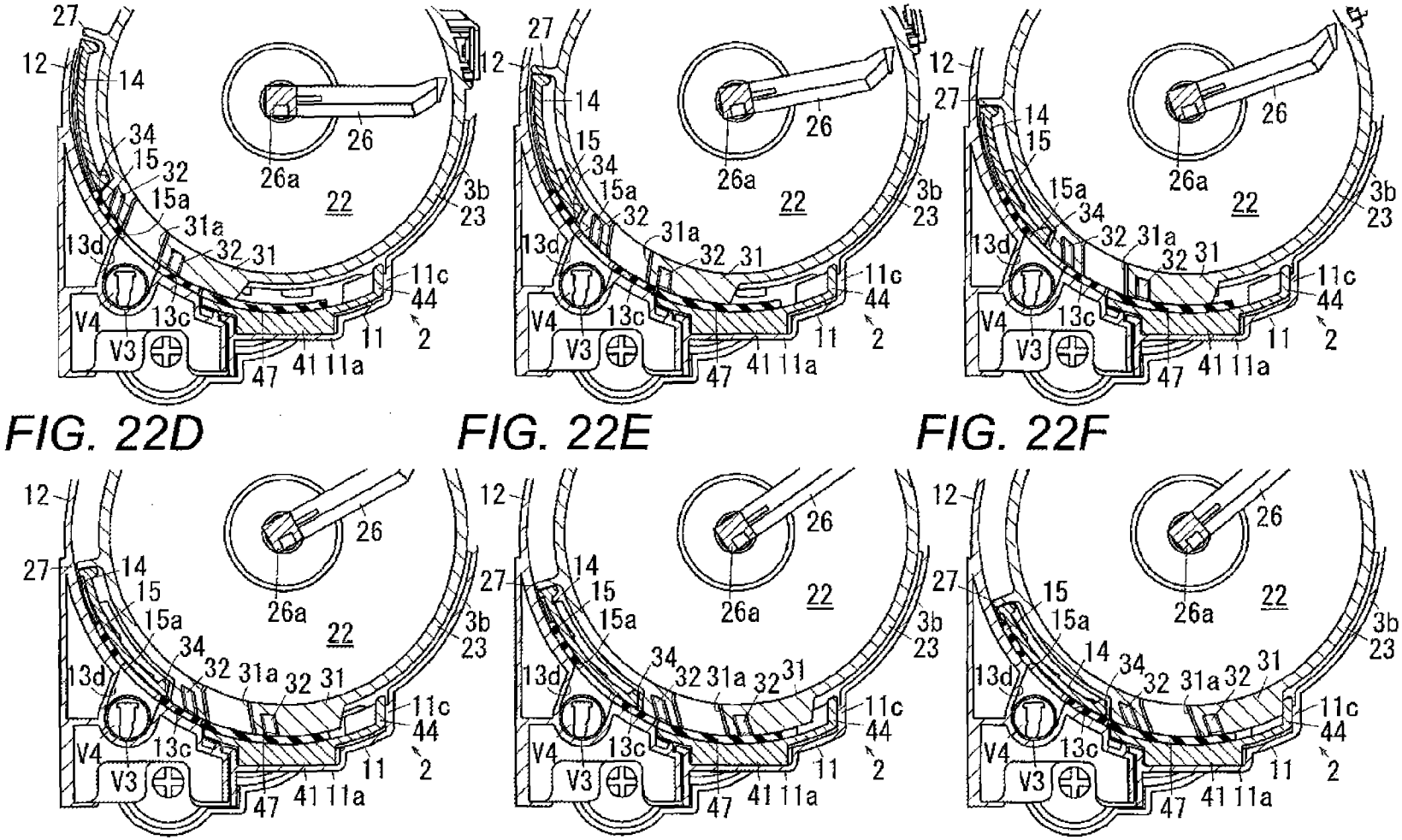
FIGS. 22A to 22F are explanation diagrams describing steps that a toner cartridge moves from a locked position to an unlocked position.

FIGS. 22A to 22F are explanation diagrams describing steps that a toner cartridge moves from a locked position to an unlocked position. FIG. 22A is an explanation diagram showing a state that a toner cartridge has moved to a locked position. FIG. 22B is an explanation diagram showing a state that a toner cartridge has moved from a position shown in FIG. 22A to an unlocked position side. FIG. 22C is an explanation diagram showing a state that a toner cartridge has moved further from a position shown in FIG. 22B to an unlocked position side. FIG. 22D is an explanation diagram showing a state that a toner cartridge has moved further from a position shown in FIG. 22C to an unlocked position side. FIG. 22E is an explanation diagram showing a state that a toner cartridge has moved further from a position shown in FIG. 22D to an unlocked position side. FIG. 22F is an explanation diagram showing a state that a toner cartridge has moved to an unlocked position side.

In FIGS. 22A to 22F, even in a case that the toner cartridge TC moves from a locked position to an unlocked position, similarly to the case shown in FIGS. 21A to 21F, the seals 15 and 47 are guided downward by the guide surface of the collection grooves 32 or the outlet 31*a* so that breakage is reduced.

In particular, when the toner cartridge TC moves toward an unlocked position, in association with a friction from the outlet seal 47, the cartridge shutter guide 36, and the like, a force causing movement in the counterclockwise direction in FIGS. 22A to 22F which is the rotation direction of the toner cartridge TC acts on the cartridge shutter 41. If a large backlash were formed that allows the cartridge shutter 41 to move along the rotation direction of the toner cartridge TC, the outlet seal 47 could move in the direction of departing from the inlet seal 15 so that a gap could be formed between the seals 15 and 47. This causes a possibility that developer could leak out through the gap. In contrast, in Exemplary Embodiment 1, when the cartridge shutter 41 is to move, the backlash stuffing section 11*c* contacts with the right wall 44 of the cartridge shutter 41 so that the movement of the cartridge shutter 41 is restricted. Thus, the seals 15 and 47 hardly depart from each other, and hence formation of a gap is reduced. A state that the seals 15 and 47 shrink is easily maintained so that leakage of developer is reduced.

Figure 23A:
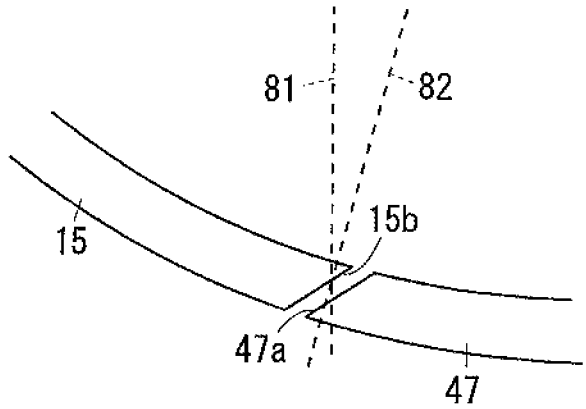
FIGS. 23A and 23B are explanation diagrams of end parts of seals.
Figure 23B:
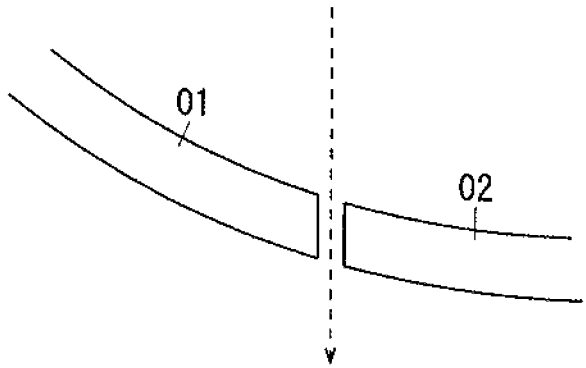

FIGS. 23A and 23B are explanation diagrams of end parts of seals. FIG. 23A is an explanation diagram of seals according to Exemplary Embodiment 1. FIG. 23B is an explanation diagram of conventional seals.

In FIGS. 23A and 23B, in the seals 15 and 47 according to Exemplary Embodiment 1, the end faces 15*b* and 47*a* are formed in an inclined manner relative to the gravity direction 81. In a supposed case that the end faces of the seals 01 and 02 are formed along the gravity direction as shown in FIG. 23B, when a gap is formed, developer falls down through the gap. In contrast, in the configuration according to Exemplary Embodiment 1 shown in FIG. 23A, even when a gap is formed between the seals 15 and 47, a state is easily realized that the end faces 15*b* and 47*a* partly overlap with each other when viewed from the gravity direction. That is, developer falling in the gravity direction 81 adheres to any one of the end faces 15*b* and 47*a* and hence hardly pass downward through the seals 15 and 47. Thus, leakage of developer is reduced.

Further, the end faces 15*b* and 47*a* of the seals 15 and 47 according to Exemplary Embodiment 1 are formed in an inclined manner relative also to the radial direction 82. Thus, even if a gap were formed, a state is easily realized that the end faces 15*b* and 47*a* partly overlap with each other when viewed from the radial direction 82. Thus, even when developer moves in the radial direction owing to a centrifugal force or the like generated in association with the rotation of the toner cartridge TC, leaking to the outside is reduced.

Further, in Exemplary Embodiment 1, a toner pocket 11*e* is formed under the stopper surface 11*d*, that is, under the end face 15*b* of the inlet seal 15. Thus, even if developer fall through a gap between the seals 15 and 47, the developer is collected into the toner pocket 11*e*. In particular, in Exemplary Embodiment 1, the width of the toner pocket 11*e* in the front and rear directions is set to be greater than the width of the outlet 31*a*. This reduces an occasion that developer in the toner pocket 11*e* falls to the outside.

Thus, an occasion is reduced that the printer U and the toner cartridge TC get dirty in association with leakage of developer. Thus, occurrence of problems is reduced, like leaked developer goes inside the printer U so as to cause malfunction, developer drops to the outside of the printer U so that a user's hand or dress get dirty, and the floor gets dirty.

(Explanation of Relation Between Toner Cartridge Rotation and Collection Groove)

In FIGS. 21A to 21F, when the toner cartridge TC moves toward a locked position, at the time that the outlet 31*a* passes, developer in the outlet 31*a* adheres to the surface of the seals 15 and 47. In FIGS. 22A to 22F, when the toner cartridge TC moves toward an unlocked position, in a conventional configuration that the collection grooves 32 are not provided in the upstream and the downstream in the counterclockwise direction in FIGS. 22A to 22F which is the rotation direction of the outlet 31*a*, a state is maintained that developer has adhered to the seals 15 and 47 in a region where the outlet 31*a* has passed. Thus, when the toner cartridge TC is rotated in the counterclockwise direction in FIGS. 21A to 21F and 22A to 22F, a possibility arises that the developer is scraped by the edge of the outlet section 31, the protruding frame 33, or the like so as to leak to the outside. In contrast, in Exemplary Embodiment 1, the collection grooves 32 is provided on both sides in the counterclockwise direction which is the rotation direction of the outlet 31*a*, in particular, on the left side which is the downstream side. Thus, at the time that the collection grooves 32 passes, developer having adhered from the outlet 31*a* to the surface of the seals 15 and 47 is scraped and then collected into the collection grooves 32. Thus, leakage of developer to the outside is reduced.

In particular, in Exemplary Embodiment 1, the downstream end 32*a* of the collection grooves 32 is formed in an acute angle relative to the outer peripheral surface 31*b*. Thus, when the toner cartridge TC moves toward an unlocked position in the counterclockwise direction, developer having adhered to the seals 15 and 47 is easily scraped and collected. Further, when the toner cartridge TC moves toward a locked position in the clockwise direction, the upstream end 32*b* set up in an obtuse angle contacts with and scrapes the seals 15 and 47. Thus, in comparison with a case of a non-obtuse angle, damage to the seals 15 and 47 is reduce.

Further, in Exemplary Embodiment 1, even when the toner cartridge TC moves toward a locked position, the collection groove 32 on the downstream side of the outlet 31*a*, that is, on the right side, can collect developer. Thus, in comparison with a case that collection is not performed when movement is toward a locked position, leakage of developer is reduced further.

Figure 24A:
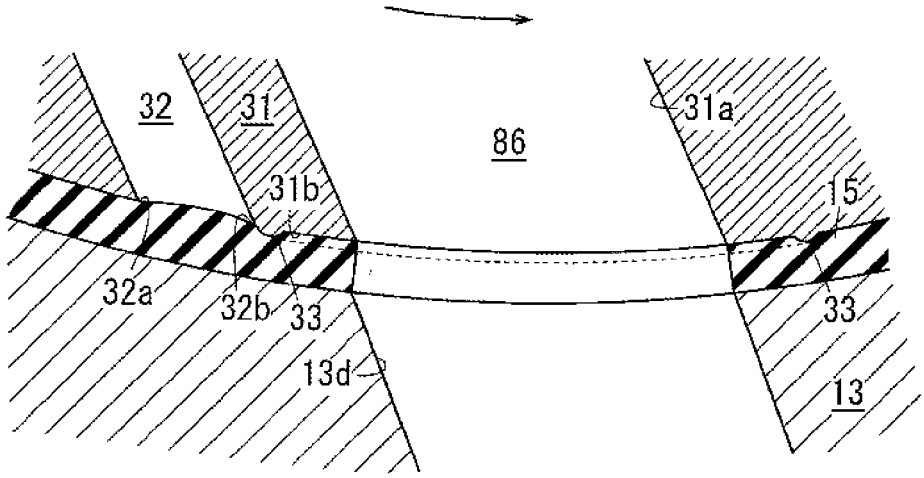
FIGS. 24A and 24B are explanation diagrams showing a main part of a collection groove part according to Exemplary Embodiment 1.
Figure 24B:
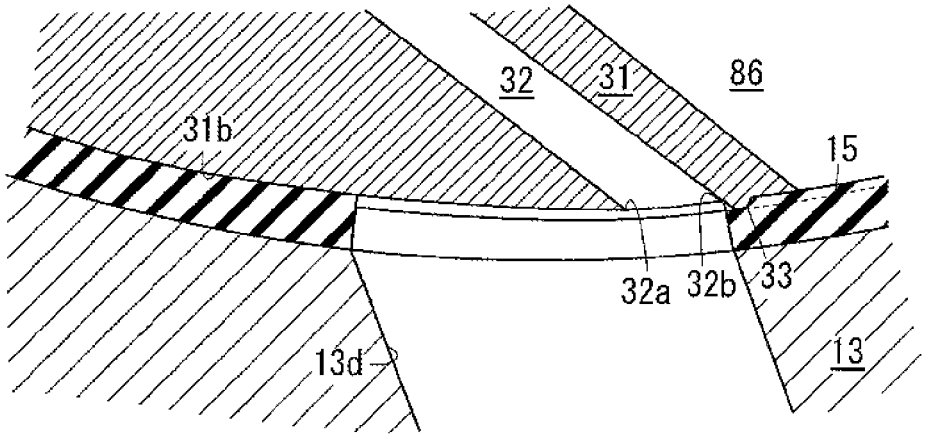

FIGS. 24A and 24B are explanation diagrams showing a main part of a collection groove part according to Exemplary Embodiment 1. FIG. 24A is an explanation diagram showing a state that a toner cartridge has moved to a locked position. FIG. 24B is an explanation diagram showing a state that a toner cartridge has moved from a locked position toward an unlocked position.

In FIGS. 24A and 24B, in Exemplary Embodiment 1, the outer edges 32*a* and 32*b* of the collection grooves 32 are arranged inside in the radial direction in comparison with the outer edge of the protruding frame 33. Thus, the amount of elastic deformation of the inlet seal 15 in the radial direction, that is, the amount of shrinkage of the inlet sheet 15, is smaller in the part of the collection grooves 32 than in the part of the protruding frame 33. Thus, as shown in FIGS. 24A and 24B, when the toner cartridge TC moves from a locked position toward an unlocked position, when developer 86 remains in the inlet 13*d* and the outlet 31*a* as shown in FIG. 24A, at the time that the protruding frame 33 passes, the developer 86 in the upper part on the inlet 13*d* side is scraped as shown in FIG. 24B. Thus, when the collection grooves 32 pass through the position of the inlet 13*d*, a possibility is reduced that the outer edges 32*a* and 32*b* of the collection grooves 32 arranged inside the protruding frame 33 erroneously scrapes the developer in the upper part of the inlet 13*d*, that is, the developer not having leaked out or not having adhered to the surface of the inlet seal 15.

(Explanation of Attaching and Detaching of CRUM)

In FIGS. 17A and 17B, in the toner cartridge TC according to Exemplary Embodiment 1, the CRUM holder 62 accommodating the CRUM 61 is inserted from the front direction into the toner cartridge body TC1. Then, in a state that the cartridge cover TC2 is attached, the dropping prevention section 72*b* of the cartridge cover TC2 is arranged in the front direction so as to restrict forward movement of the CRUM holder 62. Thus, even in a case of breakage of the snap fit fix section 54 or dropping caused by a manufacturing error or the like, dropping of the CRUM 61 from the toner cartridge TC is reduced.

(Modifications)

An embodiment of the present invention has been described above in full detail. However, the present invention is not limited to this embodiment. That is, various kinds of change may be applied within the spirit of the present invention described in the claims. Modifications (H01) to (H014) of the present invention are illustrated below.

(H01) The embodiment given above has been illustrated for a printer serving as an example of an image forming apparatus. However, the present invention is not limited to this. For example, a copying machine, a FAX machine, or a composite machine having the functions of one or a plurality of these may be employed.

(H02) The embodiment given above has been illustrated for a configuration that in the printer U, monochromatic developer is employed. However, the present invention is not limited to this and is applicable also to, for example, a multicolor image forming apparatus of two or more colors. At that time, the hardkeys 11*b* and 46*a* may be provided in accordance with differences in the color of developer accommodated in the toner cartridge TC, the composition and the melting point of developer, the type of toner such as fluidity, the dedicated customer of the toner cartridge, and the like. As such, identification of these may be achieved.

(H03) The embodiment given above has been illustrated for a configuration that the CRUM 61 is attached to the cartridge body TC1 via the CRUM holder 62. However, the present invention is not limited to this. That is, the CRUM holder 62 may be omitted.

(H04) In the embodiment given above, the configuration of the CRUM holder 62 is not limited to that illustrated in the embodiment. That is, the external shape may be changed in accordance with the design, the specification, and the like. For example, although a configuration has been illustrated that the CRUM holder 62 is fixed to the cartridge body TC1 by a so-called snap fit structure, this may be omitted. That is, an arbitrary change may be employed like the position of CRUM entrance 67 is changed and the shape and the length of the to-be guided section 64 are changed.

(H05) The embodiment given above has been illustrated for a configuration that the restriction body for restricting the dropping of the CRUM 61 is formed in the cartridge cover TC2, that is, a configuration that the restriction body and the cartridge cover are constructed in common. However, the present invention is not limited to this. For example, the restriction body for restricting the movement of the CRUM 61 may be constructed separately from the cartridge cover. The shape of the restriction body is also not limited to the shape of a barrel wall. For example, an arbitrary shape may be employed like an O-ring shape and a bracket shape.

(H06) In the embodiment given above, a configuration is preferable that the collection grooves 32 are provided on both sides of the outlet 31*a*. However, the present invention is not limited to this. That is, a collection groove may be provided on any one of the two sides where leakage of developer causes a more serious problem depending on the design, the specification, and the like. Further, it is preferable that the width of the collection grooves 32 in the front and rear directions is larger than the outlet 31*a*. However, the width may be the same or alternatively narrower.

(H07) In the embodiment given above, a configuration is preferable that when rotating toward an unlocked position, the collection grooves 32 contacts with the seals 15 and 47 at an acute angle. However, the present invention is not limited to this. That is, a right angle or an obtuse angle may be employed.

(H08) In the embodiment given above, a configuration is preferable that the width of the toner pocket 11*e* is larger than that of the outlet 31*a*. However, the present invention is not limited to this. That is, the width may be smaller. Further, the toner pocket 11*e* is preferably provided, however, may be omitted.

(H09) In the embodiment given above, a configuration is preferable that the protruding frame 33 is provided and then the outer edges 32*a* and 32*b* of the collection grooves 32 are located inside the outlet 31*a*. However, the present invention is not limited to this. That is, the protruding frame 33 may be omitted, and then the outer edges 32*a* and 32*b* of the collection grooves 32 may be located at or may protrudes outside the outer peripheral surface 31*b* of the outlet 31*a* so that the contact pressure between the collection grooves 32 and the seals 15 and 47 may be increased. This permits more reliable collection.

(H010) The embodiment given above has been illustrated for a case that both of the seals 15 and 47 protrude relative to the stopper surface 11*d* and the left end of the cartridge shutter 41. However, the present invention is not limited to this. That is, a configuration may be employed that at least one of these protrudes relative to the stopper surface 11*d* or the left end of the cartridge shutter 41. This provides a similar operation effect.

(H011) In the embodiment given above, it is preferable that the inclined surfaces 15*b* and 47*a* are formed at the ends of the seals 15 and 47. However, surfaces aligned with the gravity direction or surfaces aligned with the radial direction may be employed.

(H012) The embodiment given above has been illustrated for a configuration that the backlash stuffing section 11*c* is provided so that backlash of the cartridge shutter 41 is reduced. However, the present invention is not limited to this. For example, a configuration may be employed that the hardkeys 11*b* and 46*a* reduce backlash of the cartridge shutter 41, that is, the backlash stuffing section 11*c* is omitted and the hardkeys are provided with the function of a backlash stuffing section so that the functions are realized in common.

(H013) The embodiment given above has been illustrated for a configuration that the width of the collection grooves 32 in the front and rear directions is formed greater than the width of the outlet 31*a* in the front and rear directions. However, the present invention is not limited to this. That is, the same width may be employed, or alternatively they may be divided into a plurality of units.

(H014) The embodiment given above has been illustrated for a configuration that the toner cartridge TC having a cylindrical shape is employed. However, the present invention is not limited to this. That is, the toner cartridge TC may have an elliptical shape, a quadrangular shape, and another polygonal shape.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a powder container body that is attached to a body of the image forming apparatus in an attachable and detachable manner, the powder container body that includes:

an accommodation section that accommodates powder, an outlet that connects the accommodation section to an outside and allows the powder to flow out therethrough, and a recess that is arranged on a side of the outlet and that is formed in a shape depressed in a direction of departing relative to an opening and closing member;

a container support section that supports the powder container body in the attachable and detachable manner, the container support section that includes:

an inlet that is connected to the outlet, and a leakage preventing member that is arranged in surroundings of the inlet and contacts with surroundings of the outlet so as to prevent leakage of the powder; and the opening and closing member that is supported in a movable manner relative to the powder container body between an open position where the outlet is opened and a closed position where the outlet is closed, and that moves relative to the powder container body when, in a state that the powder container body is supported by the container support section, the powder container body is moved in an opening or a closing direction set up in advance, wherein an angle, relative to the leakage preventing member, of an end of the recess on an upstream side in a direction of movement of the recess in contact with the leakage preventing member in a case that the opening and closing member relatively moves from the open position toward the closed position is set to be an obtuse angle.

2. The image forming apparatus according to claim 1, wherein the recess has a width along a direction crossing the direction of movement of the powder container body being greater than or equal to a width of the outlet.

3. The image forming apparatus according to claim 1, wherein the leakage preventing member is elastically deformable, and an amount of deformation in elastic deformation caused when a part of the recess contacts with the leakage preventing member is set up smaller than an amount of deformation in elastic deformation caused when a part of the outlet contacts with the leakage preventing member.

* * * * *